US011714363B2

(12) United States Patent
Ookubo et al.

(10) Patent No.: US 11,714,363 B2
(45) Date of Patent: Aug. 1, 2023

(54) TONER

(71) Applicant: CANON KABUSHIKI KAISHA, Tokyo (JP)

(72) Inventors: Kenji Ookubo, Shizuoka (JP); Yu Yoshida, Shizuoka (JP); Takashi Kenmoku, Shizuoka (JP); Taku Shimoda, Tokyo (JP); Masashi Kawamura, Kanagawa (JP); Akane Masumoto, Shizuoka (JP); Takayuki Toyoda, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 96 days.

(21) Appl. No.: 17/352,672

(22) Filed: Jun. 21, 2021

(65) Prior Publication Data

US 2021/0405549 A1 Dec. 30, 2021

(30) Foreign Application Priority Data

Jun. 25, 2020 (JP) ..... 2020-109990

(51) Int. Cl.
*G03G 9/087* (2006.01)
*G03G 9/097* (2006.01)
*G03G 9/08* (2006.01)

(52) U.S. Cl.
CPC ..... *G03G 9/09725* (2013.01); *G03G 9/0827* (2013.01); *G03G 9/08773* (2013.01)

(58) Field of Classification Search
CPC ..... G03G 9/09708; G03G 9/09725; G03G 9/09783
See application file for complete search history.

(56) References Cited

U.S. PATENT DOCUMENTS 5,620,825 A 4/1997 Tavernier
6,777,153 B2 8/2004 Yano et al.
6,808,907 B2 10/2004 Honma et al.
6,908,721 B2 6/2005 Kenmoku et al.
6,911,520 B2 6/2005 Fukui et al.
7,045,321 B2 5/2006 Imamura et al.
7,141,342 B2 11/2006 Toyoda et al.
7,264,910 B2 9/2007 Toyoda et al.
7,288,357 B2 10/2007 Toyoda et al.
7,393,912 B2 7/2008 Mihara et al.
7,399,568 B2 7/2008 Fukui et al.
7,408,017 B2 8/2008 Imamura et al.
7,452,960 B2 11/2008 Yano et al.
7,510,813 B2 3/2009 Yano et al.
7,638,194 B2 12/2009 Fukui et al.
7,638,590 B2 12/2009 Fukui et al.
7,682,765 B2 3/2010 Sugawa et al.
7,795,363 B2 9/2010 Fukui et al.
7,833,685 B2 11/2010 Tanaka et al.
7,833,687 B2 11/2010 Kato et al.
7,935,771 B2 5/2011 Fukui et al.
8,067,136 B2 11/2011 Yano et al.
8,093,342 B2 1/2012 Minami et al.
8,110,329 B2 2/2012 Tominaga et al.
8,178,271 B2 5/2012 Fukui et al.
8,211,606 B2 7/2012 Murai et al.
8,377,616 B2 2/2013 Tani et al.
8,383,312 B2 2/2013 Fujimoto et al.
8,574,801 B2 11/2013 Itabashi et al.
8,609,312 B2 12/2013 Itabashi et al.
8,628,899 B2 1/2014 Kawamura et al.
8,697,327 B2 4/2014 Shibata et al.
8,815,484 B2 8/2014 Tanaka et al.
8,828,633 B2 9/2014 Itabashi et al.
8,916,319 B2 12/2014 Ikeda et al.
8,940,467 B2 1/2015 Hashimoto et al.
9,029,056 B2 5/2015 Kenmoku et al.
9,098,002 B2 8/2015 Kenmoku et al.
9,098,003 B2 8/2015 Masumoto et al.
9,146,485 B2 9/2015 Tani et al.
9,158,216 B2 10/2015 Shimano et al.
9,377,705 B2 6/2016 Shimano et al.
9,383,668 B2 7/2016 Noji et al.
9,423,708 B2 8/2016 Tominaga et al.
9,423,714 B2 8/2016 Kenmoku et al.
9,556,290 B2 1/2017 Nishiura et al.
9,575,424 B2 2/2017 Nakagawa et al.
9,599,919 B2 3/2017 Isono et al.
9,715,187 B2 7/2017 Mukumoto et al.
9,720,340 B2 8/2017 Tominaga et al.
9,733,584 B2 8/2017 Masumoto et al.
9,785,071 B2 10/2017 Shimano et al.
9,829,814 B2 11/2017 Yoshida et al.
9,829,816 B2 11/2017 Tanaka et al.
(Continued)

FOREIGN PATENT DOCUMENTS

EP 0 740 217 A1 10/1996
JP 4-50859 A 2/1992
(Continued)

OTHER PUBLICATIONS

Translation of JP 2004-102236.*
Translation of JP 2018-00949.*

*Primary Examiner* — Peter L Vajda
(74) *Attorney, Agent, or Firm* — Venable LLP

(57) ABSTRACT

A toner comprising a toner particle comprising a resin A, and an external additive A, wherein the resin A is a resin represented by formula (1) below, the resin A is present at the surface of the toner particle, the external additive A is a fine particle containing silicon, the average value of the shape factor SF-1 of the external additive A is from 105 to 120, the average value of the shape factor SF-2 of the external additive A is from 100 to 130.

(1)

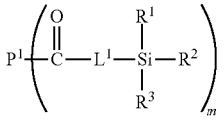

10 Claims, No Drawings

(56) References Cited

U.S. PATENT DOCUMENTS

| | | | |
|---|---|---|---|
| 9,829,820 | B2 | 11/2017 | Masumoto et al. |
| 9,835,964 | B2 | 12/2017 | Yoshida et al. |
| 9,857,711 | B2 | 1/2018 | Yoshida et al. |
| 9,880,478 | B2 | 1/2018 | Shimano et al. |
| 9,897,932 | B2 | 2/2018 | Hotta et al. |
| 9,897,933 | B2 | 2/2018 | Yoshida et al. |
| 9,921,501 | B2 | 3/2018 | Mochizuki et al. |
| 9,964,879 | B2 | 5/2018 | Terui et al. |
| 10,012,922 | B2 | 7/2018 | Yoshida et al. |
| 10,054,866 | B2 | 8/2018 | Tanaka et al. |
| 10,078,285 | B2 | 9/2018 | Kubo et al. |
| 10,114,303 | B2 | 10/2018 | Katsura et al. |
| 10,295,920 | B2 | 5/2019 | Nishikawa et al. |
| 10,295,922 | B2 | 5/2019 | Terui et al. |
| 10,303,074 | B2 | 5/2019 | Yamawaki et al. |
| 10,303,075 | B2 | 5/2019 | Tanaka et al. |
| 10,416,582 | B2 | 9/2019 | Nakagawa et al. |
| 10,429,757 | B2 | 10/2019 | Yoshida et al. |
| 10,437,165 | B2 | 10/2019 | Shimano et al. |
| 10,503,090 | B2 | 12/2019 | Tominaga et al. |
| 10,545,420 | B2 | 1/2020 | Kinumatsu et al. |
| 10,545,422 | B2 | 1/2020 | Yamawaki et al. |
| 10,551,758 | B2 | 2/2020 | Tanaka et al. |
| 10,747,136 | B2 | 8/2020 | Kenmoku et al. |
| 10,877,390 | B2 | 12/2020 | Shimano et al. |
| 2005/0260514 | A1 | 11/2005 | Mihara et al. |
| 2006/0194071 | A1 | 8/2006 | Yano et al. |
| 2008/0299482 | A1 | 12/2008 | Kato et al. |
| 2010/0035171 | A1 | 2/2010 | Watanabe et al. |
| 2012/0172562 | A1 | 7/2012 | Kenmoku et al. |
| 2013/0065174 | A1 | 3/2013 | Itabashi et al. |
| 2013/0149640 | A1* | 6/2013 | Ishii ..... G03G 9/09328 430/108.7 |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2020/0341395 | A1 | 10/2020 | Ookubo et al. |
| 2020/0341398 | A1 | 10/2020 | Kawamura et al. |
| 2020/0341400 | A1 | 10/2020 | Shimoda et al. |
| 2021/0026261 | A1 | 1/2021 | Ogaki et al. |
| 2021/0026262 | A1 | 1/2021 | Kenmoku et al. |
| 2021/0026263 | A1 | 1/2021 | Uchiyama et al. |
| 2021/0026264 | A1 | 1/2021 | Kamikura et al. |
| 2021/0026265 | A1 | 1/2021 | Kamikura et al. |
| 2021/0026266 | A1 | 1/2021 | Toyoizumi et al. |
| 2021/0132519 | A1 | 5/2021 | Hashimoto et al. |

FOREIGN PATENT DOCUMENTS

| | | | | |
|---|---|---|---|---|
| JP | 3089206 | B2 | 9/2000 | |
| JP | 2004-102236 | * | 4/2004 | ..... G03G 9/08 |
| JP | 2016-11992 | A | 1/2016 | |
| JP | 2017-32598 | A | 2/2017 | |
| JP | 2018-00949 | * | 1/2018 | ..... G03G 9/08 |

* cited by examiner

TONER

BACKGROUND OF THE INVENTION

Field of the Invention

The present disclosure relates to a toner used in a recording method that employs an electrophotography or the like.

Description of the Related Art

As intended uses and usage environments of image forming apparatuses such as copiers and printers have become more varied in recent years, there have been demands for longer service life and higher image quality.

A variety of means are known as image forming methods, but among these, electrophotography is a principal technology. Processes carried out in electrophotography are as follows. First, an electrostatic latent image is formed on an electrostatic image bearing member (hereinafter also referred to as a "photosensitive member") using a variety of means. Next, the latent image is converted into a visible image by developing with a developer (hereinafter also referred to as a "toner"), the toner image is transferred to a recording medium such as a paper if necessary, and the toner image is fixed on the recording medium by means of heat, pressure, or the like, so as to obtain a copied article.

In these toners, functional particles such as silica fine particles are often externally added to a toner particle surface in order to attain high image quality. However, toner characteristics gradually change because the functional particles become embedded into the toner particle surface over long term use. In particular, if the fluidity of a toner decreases, toner aggregation readily occurs, aggregated toner becomes stuck to members such as photosensitive members and developing blades, and image defects known as image streaks occur.

As techniques for solving this problem, Japanese Patent Application Publication Nos. 2017-032598 and H04-050859 disclose means for reducing embedding of functional particles by using spherical silica fine particles or spherical silicone fine particles as spacers.

SUMMARY OF THE INVENTION

A spherical external additive can not only disperse embedding pressure in order to bring about planar contact with a toner particle surface, but the external additive itself is effective in terms of acting as a bearing so as to enable an improvement in fluidity. At the time of external addition, however, because mechanical impacts imparted in order to fix the external additive are also dispersed, it is difficult to fix the external additive to a toner particle surface, and the spherical external additive itself migrates to other members as a result of long term use.

Therefore, because long term use causes a decrease in fluidity, it is not possible to fully solve problems such as image streaks. Furthermore, in cases where a migrated spherical external additive contaminates a member involved in charging, such as a development blade, image defects known as image fogging occur. Therefore, there is a need for a technique that can adequately suppress this migration even if a spherical external additive is used.

The present disclosure provides a toner in which detachment of a spherical external additive is suppressed and image streaks and image fogging can be suppressed even after long term use.

The present disclosure relates to a toner comprising a toner particle comprising a resin A, and an external additive A, wherein the resin A is a resin represented by formula (1) below, the resin A is present at the surface of the toner particle, the external additive A is a fine particle containing silicon, the average value of the shape factor SF-1 of the external additive A is from 105 to 120, the average value of the shape factor SF-2 of the external additive A is from 100 to 130:

in formula (1), $P^1$ denotes a polymer segment, $L^1$ denotes a single bond, an alkylene group having from 1 to 4 carbon atoms, —O—, —$OR^4$—, —NH—, —$NHR^5$— or a phenylene group, $R^4$ and $R^5$ are each independently an alkylene group having from 1 to 4 carbon atoms or a phenylene group, and each carbon atom may have a hydroxyl group as a substituent group, at least one of $R^1$ to $R^3$ is a hydroxyl group or an alkoxy group, with the remainder each independently denoting a hydrogen atom, a halogen atom, an alkyl group, an alkoxy group, an aryl group or a hydroxyl group, m is a positive integer, and in cases where the value of m is 2 or higher, a plurality of $L^1$ moieties, a plurality of $R^1$ moieties, a plurality of $R^2$ moieties and a plurality of $R^3$ moieties may be the same as, or different from, each other.

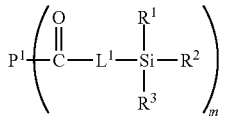

(1)

According to the present disclosure, it is possible to provide a toner in which detachment of a spherical external additive is suppressed and image streaks and image fogging can be suppressed even after long term use. Further features of the present invention will become apparent from the following description of exemplary embodiments.

DESCRIPTION OF THE EMBODIMENTS

Embodiments will now be explained in detail, but the present invention is in no way limited to the explanations given below. In the present disclosure, the notations "from XX to YY" and "XX to YY" representing a numerical range denote, unless otherwise stated, a numerical value range that includes the lower limit and the upper limit thereof, as endpoints.

The "monomer unit" refers to the reacted form of the monomer substance in the polymer or the resin.

In a case where numerical value ranges are described in stages, the upper limits and the lower limits of the respective numerical value ranges can be combined arbitrarily.

The present disclosure relates to a toner comprising a toner particle comprising a resin A, and an external additive A, wherein the resin A is a resin represented by formula (1) below, the resin A is present at the surface of the toner particle, the external additive A is a fine particle containing silicon, the average value of the shape factor SF-1 of the external additive A is from 105 to 120, the average value of the shape factor SF-2 of the external additive A is from 100 to 130.

(In formula (1), $P^1$ denotes a polymer segment, $L^1$ denotes a single bond, an alkylene group having from 1 to 4 carbon atoms, —O—, —$OR^4$—, —NH—, —$NHR^5$— or a phenylene group. $R^4$ and $R^5$ are each independently an alkylene group having from 1 to 4 carbon atoms or a phenylene group, and each carbon atom may have a hydroxyl group as a substituent group. At least one of $R^1$ to $R^3$ is a hydroxyl group or an alkoxy group, with the remainder each independently denoting a hydrogen atom, a halogen atom, an alkyl group, an alkoxy group, an aryl group or a hydroxyl group. m is a positive integer, and in cases where the value of m is 2 or higher, a plurality of $L^1$ moieties, a plurality of $R^1$ moieties, a plurality of $R^2$ moieties and a plurality of $R^3$ moieties may be the same as, or different from, each other.)

(1)

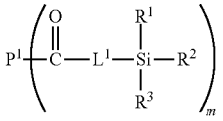

The inventors of the present invention found that by using said toner, it is possible to provide a toner in which detachment of a spherical external additive is suppressed and image streaks and image fogging can be suppressed even after long term use. It is surmised that the reasons for this are as follows.

When an image is formed, the toner is rubbed by a roller or a development blade, and fine particles that are externally added to the toner particle surface are subjected to a pressure that embeds the fine particles in the inner part of the toner particle. Because a spherical external additive undergoes planar contact with a toner particle surface compared to a non-spherical external additive, the embedding pressure applied to the external additive is dispersed. Therefore, a spherical external additive is unlikely to be embedded in the inner part of a toner particle, and because the spherical external additive acts as a bearing, toner fluidity is improved and is maintained for a long time. As a result, the toner is unlikely to be fixed to a developing member and image defects such as image streaks are unlikely to occur.

Conversely, because a spherical external additive is unlikely to become embedded in the inner part of a toner particle, it is difficult to fix the spherical external additive to the toner particle surface, and the spherical external additive per se readily migrates to other members as a result of long term use. Therefore, migration of the spherical external additive leads to problems such as contamination of members and a decrease in fluidity, and causes image defects such as image streaks and image fogging as a result of long term use.

In the toner mentioned above, because the resin A contains silicon, in cases where the resin A is present at a toner particle surface, affinity between the resin A and the silicon-containing external additive increases and adhesion readily occurs between the toner particle and the external additive.

In addition, in cases where the average value of the shape factor SF-1 of the external additive is from 105 to 120 and the average value of the shape factor SF-2 is from 100 to 130, the external additive has properties close to those of a smooth sphere, and easily rolls over the toner particle surface. In cases where the external additive rolls over the toner particle surface, interfaces between tightly bonded toner particles and external additive are continuously separated, and positive peeling charge is generated in the toner particle and negative peeling charge is generated in the external additive.

In addition, the resin A includes a C═O segment and a Si—O segment, and these segments are positioned either side $L^1$. $L^1$ is a single bond, an alkylene group having from 1 to 4 carbon atoms, —O—, —$OR^4$—, —NH—, —$NHR^5$— or a phenylene group, and $R^4$ and $R^5$ are each independently an alkylene group having from 1 to 4 carbon atoms or a phenylene group. In this case, polarization of the C═O segment and polarization of the Si—O segment exist within the range where both segments can produce electrostatic interactions and can bring about charge transfer.

As a result of this charge transfer, a higher number of electrons are transferred to the external additive from the resin A upon peeling charging, meaning that peeling charge between the toner particle and the external additive is further increased. As a result, electrostatic attraction between the toner particle and the external additive fully acts, and it is possible to suppress detachment of the external additive from the toner particle surface. Therefore, it is possible to suppress image streaks and image fogging even after long term use.

The toner will now be explained.

First, the resin A will be discussed.

The toner particle contains the resin A. The resin A is represented by formula (1) below.

(1)

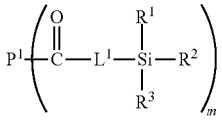

In formula (1), $P^1$ denotes a polymer segment, $L^1$ denotes a single bond, an alkylene group having from 1 to 4 carbon atoms, —O—, —$OR^4$—, —NH—, —$NHR^5$— or a phenylene group. $R^4$ and $R^5$ are each independently an alkylene group having from 1 to 4 carbon atoms or a phenylene group, and each carbon atom may have a hydroxyl group as a substituent group. In —$OR^4$—, —NH— and —$NHR^5$—, O or N preferably bonds to a carbonyl group in formula (1).

At least one of $R^1$ to $R^3$ is a hydroxyl group or an alkoxy group, with the remainder each independently denoting a hydrogen atom, a halogen atom, an alkyl group, an alkoxy group, an aryl group or a hydroxyl group. m is a positive integer, and in cases where the value of m is 2 or higher, a plurality of $L^1$ moieties, a plurality of $R^1$ moieties, a plurality of $R^2$ moieties and a plurality of $R^3$ moieties may be the same as, or different from, each other.

In addition, $R^1$ to $R^3$ in formula (1) are preferably each independently an alkoxy group or a hydroxyl group.

The number of carbons in the alkyl group is preferably 1 to 4 and more preferably 1 to 3.

The number of carbons in the alkoxy group is preferably 1 to 4 and more preferably 1 to 3.

The number of carbons in the aryl group is preferably 6 to 12 and more preferably 6 to 10.

In order to have at least one of $R^1$ to $R^3$ in formula (1) be a hydroxy group, for example, a resin in which at least one of $R^1$ to $R^3$ is an alkoxy group may be subjected to hydrolysis in order to convert the alkoxy group to the hydroxy group.

Any method may be used for hydrolysis, and the following procedure is an example.

A resin in which at least one of R' to $R^3$ in formula (1) is an alkoxy group is dissolved or suspended in a suitable solvent (this may be a polymerizable monomer), the pH is adjusted to acidity using acid or alkali, and mixing and hydrolysis are carried out.

Hydrolysis may also be carried out during toner particle production.

In formula (1), $P^1$ is a polymer segment. Examples here are a polyester segment, vinyl polymer segment (for example, a styrene-acrylic acid copolymer segment), polyurethane segment, polycarbonate segment, phenolic resin segment, and polyolefin segment.

$P^1$ in formula (1) is preferably a polyester segment. By constituting in this way, polarization of a C═O segment derived from the polyester segment can also contribute to electrostatic interactions with polarization of a Si—O segment, and it is therefore possible to more effectively suppress detachment of the spherical external additive.

Further explanations will be given of embodiments in which $P^1$ in formula (1) contains a polyester segment, but the present invention is not limited to these.

The polyester segment refers to a macromolecular segment that has the ester bond (—CO—O—) in a main chain repeat unit. An example here is a condensation polymer structure between a polyhydric alcohol (alcohol component) and a polyvalent carboxylic acid (carboxylic acid component). Specific examples are macromolecular segments in which a structure represented by the following formula (4) (structure derived from a dicarboxylic acid) is bonded, with the formation of an ester bond, with at least one structure (structure derived from a diol) selected from the group consisting of the formulas (5) to (7) given below. This may also be a macromolecular segment in which a structure represented by the formula (8) given below (structure derived from a compound having a carboxy group and a hydroxy group in the single molecule) is bonded with the formation of an ester bond.

In addition to those mentioned above, monomers disclosed in relation to the polyester resin below can be used in the polyester segment.

(4)

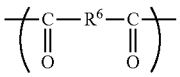

(In formula (4), $R^6$ denotes an alkylene group, alkenylene group, or arylene group.)

(5)

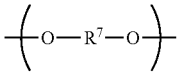

(In formula (5), $R^7$ denotes an alkylene group or a phenylene group.)

(6)

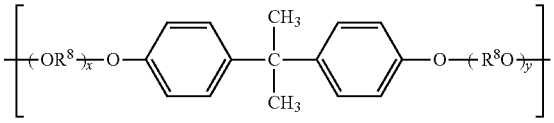

(In formula (6), $R^8$ moieties each independently denote an ethylene group or a propylene group. x and y are each independently an integer of 0 or higher, and the average value of x+y is 2 to 10.)

(7)

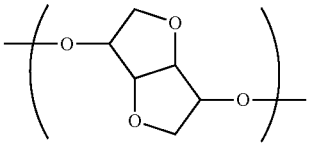

(8)

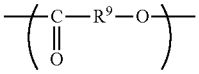

(In formula (8), $R^9$ denotes an alkylene group or alkenylene group.)

The alkylene group (preferably having 1 to 12 carbons) represented by $R^6$ in formula (4) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, 1,3-cyclopentylene, 1,3-cyclohexylene, and 1,4-cyclohexylene group.

The alkenylene group (preferably having 2 to 4 carbons) represented by $R^6$ in formula (4) can be exemplified by the vinylene group, propenylene group, and 2-butenylene group.

The arylene group (preferably having 6 to 12 carbons) represented by $R^6$ in formula (4) can be exemplified by the 1,4-phenylene group, 1,3-phenylene group, 1,2-phenylene group, 2,6-naphthylene group, 2,7-naphthylene group, and 4,4'-biphenylene group.

$R^6$ in formula (4) may be substituted by a substituent. Examples of the substituent in such a case are the methyl group, halogen atoms, carboxy group, trifluoromethyl group, and their combinations.

The alkylene group (preferably having 1 to 12 carbons) represented by $R^7$ in formula (5) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, 1,3-cyclopentylene, 1,3-cyclohexylene, and 1,4-cyclohexylene group.

The phenylene group represented by $R^7$ in formula (5) can be exemplified by the 1,4-phenylene group, 1,3-phenylene group, and 1,2-phenylene group.

$R^7$ in formula (5) may be substituted by a substituent. Examples of the substituent in such a case are the methyl group, alkoxy groups, hydroxy group, halogen atoms, and their combinations.

The alkylene group (preferably having 1 to 12 carbons) represented by $R^9$ in formula (8) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, and 1,4-cyclohexylene group.

The alkenylene group (preferably having 2 to 40 carbons) represented by $R^9$ in formula (8) can be exemplified by the following:

vinylene group, propenylene group, butenylene group, butadienylene group, pentenylene group, hexenylene group, hexadienylene group, heptenylene group, octenylene group, decenylene group, octadecenylene group, eicosenylene group, and triacontenylene group.

These alkenylene groups may have any of the following structures: straight chain, branched, and cyclic. The position of the double bond may be at any location, and at least one or more double bonds may be present.

$R^9$ in formula (8) may be substituted by a substituent. Examples of the substituent in such a case are alkyl groups, alkoxy groups, hydroxy groups, halogen atoms, and combinations of the preceding.

Examples of $L^1$ in formula (1) include structures represented by formula (3) and (9) below, but $L^1$ is not particularly limited to these. $L^1$ is preferably a structure represented by formula (3) below.

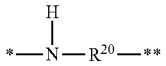

(3)

(In formula (3), * denotes a bonding segment to C═O in formula (1), and ** denotes a bonding segment to Si. $R^{20}$ denotes an alkylene group having from 1 to 4 carbon atoms or a phenylene group, and each carbon atom may have a hydroxyl group as a substituent group)

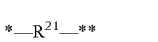

(9)

(In formula (9), $R^{21}$ denotes an alkylene group having from 1 to 4 carbon atoms or a phenylene group, and each carbon atom may have a hydroxyl group as a substituent group. * denotes a bonding segment to C═O in formula (1), and ** denotes a bonding segment to Si in formula (1).)

The structure represented by formula (3) is a divalent linking group that forms an amide bond together with C═O in formula (1).

This linking group is not limited to the case of formation by reaction. In the case of the formation of the linking group by reaction to produce the resin represented by formula (1), for example, a carboxy group-bearing compound may be reacted with an aminosilane compound (for example, a compound containing the amino group and an alkoxysilyl group, a compound containing the amino group and an alkylsilyl group, and so forth).

The aminosilane compound is not particularly limited, but can be exemplified by γ-aminopropyltriethoxysilane, γ-aminopropyltrimethoxysilane, N-β-(aminoethyl)-γ-aminopropyltrimethoxysilane, N-β-(aminoethyl)-γ-aminopropylmethyldimethoxysilane, N-phenyl-γ-aminopropyltriethoxysilane, N-phenyl-γ-aminopropyltrimethoxysilane, N-β-(aminoethyl)-γ-aminopropyltriethoxysilane, N-6-(aminohexyl)-3-aminopropyltrimethoxysilane, 3-aminopropyltrimethylsilane, and 3-aminopropylsilicon.

The alkylene group encompassed by $R^{20}$ in formula (3) may be an alkylene group that contains the —NH— group.

The structure represented by formula (3) may be a divalent linking group that forms a urethane bond together with C═O in formula (1).

This linking group is not limited to the case of formation by reaction. In the case of the formation of the linking group by reaction to produce the resin represented by formula (1), for example, a hydroxyl group-bearing compound may be reacted with an isocyanatosilane compound (for example, a compound containing the isocyanate group and an alkoxysilyl group, a compound containing the isocyanate group and an alkylsilyl group, and so forth).

The isocyanatosilane compound is not particularly limited, but can be exemplified by 3-isocyanatopropyltrimethoxysilane, 3-isocyanatopropylmethyldimethoxysilane, 3-isocyanatopropyldimethylmethoxysilane, 3-isocyanatopropyltriethoxysilane, 3-isocyanatopropylmethyldiethoxysilane, 3-isocyanatopropyldimethylethoxysilane, and 3-isocyanatopropyltrimethylsilane.

An example will now be given of an embodiment in which $P^1$ in formula (1) is a vinyl polymer segment.

Resin A can be obtained by vinyl polymerization of a vinyl compound and a silicon-containing vinyl compound. Methyl acrylate, ethyl acrylate, butyl acrylate, octyl acrylate, dimethylaminoethyl acrylate, methyl methacrylate, ethyl methacrylate, butyl methacrylate, dimethylaminoethyl methacrylate, vinyl acetate, and the like, can be used as the vinyl compound.

3-methacryloxypropyltrimethoxysilane, 3-methacryloxypropyltriethoxysilane, 3-acryloxypropyltrimethoxysilane, and the like, can be used as the silicon-containing vinyl compound.

The resin A can be obtained by subjecting these to vinyl polymerization. In such a case, other components may be polymerized in order to control characteristics. For example, it is possible to use styrene, substituted styrene compounds such as vinyltoluene, substituted vinylnaphthalene compounds, ethylene, propylene, vinyl methyl ether, vinyl ethyl ether, vinyl methyl ketone, butadiene, isoprene, maleic acid, maleic acid esters, and the like.

The method for producing the vinyl polymer is not particularly limited, and a well-known method can be used. Is possible to use one of these polymerizable monomers in isolation or a combination of a plurality of types thereof.

In the toner mentioned above, the resin A is present at the toner particle surface. This can be confirmed by obtaining a high resolution compositional image using TOF-SIMS. A detailed procedure is explained later.

Means for causing the resin A to be present at the toner particle surface are not particularly limited, but examples thereof include the methods described below. A method for obtaining a toner particle using a well-known means, such as a pulverization, in which the resin A is used in at least a part of the binder resin. A method for causing the resin A to be present at the toner particle surface by means of a difference in polarity when the toner particle is obtained in an aqueous medium, such as a suspension polymerization method, a dissolution suspension method or an emulsion aggregation method. A method for obtaining a toner particle by producing a core particle of the toner particle using a well-known method, and then forming a shell from a material that contains the resin A.

With regard to the intensity of detected Si ions, if the total ion count for ions having mass numbers of 1 to 1,800 in measurements carried out on the toner particle surface using time of flight secondary ion mass spectrometry (TOF-SIMS) is taken to be 1, the ion count derived from silicon having a mass number of 28 is preferably 0.0010 to 0.0050.

The weight average molecular weight (Mw) of the resin A is preferably from 3,000 to 100,000, and more preferably from 3,000 to 60,000. Toner storability is good if the Mw value is 3,000 or more, and low-temperature fixability is improved if the Mw value is 100,000 or less.

In addition, the content of silicon atoms in the resin A is preferably from 0.02 mass % to 2.00 mass %, and more preferably from 0.15 mass % to 1.00 mass %.

If the silicon content is 0.02 mass % or more, peeling charging occurs more satisfactorily, and durability is improved. In cases where the silicon content is 2.00 mass % or less, the state of mixing with other materials that constitute the resin A and the toner improves, and it is possible to prevent toner particles from fracturing at material interfaces.

Moreover, the content of the resin A in the toner particle is preferably from 0.1 mass % to 10.0 mass %, and more preferably from 0.1 mass % to 7.0 mass %. If the content of the resin A is 0.1 mass % or more, peeling charging occurs more satisfactorily, and better durability is achieved. In cases where the content of the resin A is 10.0 mass % or less, peeling charging can be maintained at a suitable level, and it is therefore easy to suppress a decrease in fluidity caused by charging.

The external additive A will now be discussed.

The toner contains the toner particle and the external additive A. The external additive A contains silicon. The average value of the shape factor SF-1 of the external additive A is from 105 to 120, and the average value of the shape factor SF-2 of the external additive A is from 100 to 130.

The shape factor SF-1 is an indicator that illustrates the degree of roundness of a particle, with a value of 100 being completely circular, and as the value increases, the shape of the particle becomes less circular and becomes indeterminate.

The shape factor SF-1 of the external additive, as observed using a scanning electron microscope, is preferably from 105 to 110.

The SF-1 value of the external additive can be controlled by controlling parameters in the production process of the external additive, classifying a produced external additive, and the like.

The shape factor SF-2 is an indicator that illustrates the degree of unevenness of a particle, with a value of 100 being completely circular, and as the value increases, the particle has larger protruded portions.

The shape factor SF-2 of the external additive, as observed using a scanning electron microscope, is preferably from 105 to 120.

The SF-2 value of the external additive can be controlled by controlling parameters in the production process of the external additive, classifying a produced external additive, and the like.

The external additive A is not particularly limited as long as the shape factors mentioned above are satisfied, but examples thereof include silica fine particles such as sol-gel silica fine particles and fused silica fine particles, organosilicon polymer fine particles, and combinations of these. In addition, these fine particles may be surface treated with a silane coupling agent, a titanium coupling agent, a silicone oil, or the like.

The external additive A is preferably at least silica fine particles and/or organosilicon polymer fine particles, and is more preferably silica fine particles and organosilicon polymer fine particles.

Organosilicon polymer fine particles have constituent units represented by formula (A1) to (A4) below.

Ri, Rj, Rk, Rg, Rh and Rm denote organic groups, and are preferably each independently an alkyl group having 1 to 6 (preferably 1 to 3, and more preferably 1 or 2) carbon atoms or a phenyl group.

X1

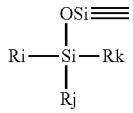

(A1)

X2

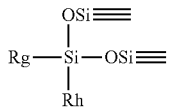

(A2)

X3

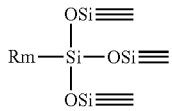

(A3)

X4

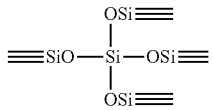

(A4)

Of these, a case where organosilicon polymer fine particles contain a large amount of a structure represented by formula (A3) (hereinafter also referred to as a "T3 unit structure") can function as an external additive and can achieve a balanced elasticity whereby an appropriate degree of deformation occurs and pressure can be effectively dispersed even when an embedding pressure is applied. That is, it is possible to obtain a particle which can impart fluidity and is unlikely to become embedded in the inner part of a toner particle.

The organosilicon polymer fine particles are preferably silsesquioxane particles. It is preferable for the organosilicon polymer in the organosilicon polymer fine particles to have a structure in which a silicon atom and an oxygen atom are bonded alternately, with some silicon atoms having a T3 unit structure represented by $R^aSiO_{3/2}$. ($R^a$ denotes an alkyl group having 1 to 6 (preferably 1 to 3, and more preferably 1 or 2) carbon atoms or a phenyl group.)

In addition, in $^{29}$Si-NMR measurements of the organosilicon polymer fine particles, the ratio of the area of a peak derived from silicon having the T3 unit structure relative to the total area of peaks derived from all silicon element contained in the organosilicon polymer in the organosilicon polymer fine particles is preferably from 0.70 to 1.00, and more preferably from 0.90 to 1.00.

In cases where $R^a$ is an alkyl group having 1 to 6 carbon atoms or a phenyl group, detachment of organosilicon polymer fine particles from the toner particle can be advantageously suppressed.

An explanation will now be given of organosilicon compounds used for producing the organosilicon polymer fine particles.

The organosilicon polymer is preferably a condensation polymerization product of an organosilicon compound having a structure represented by formula (Z) below.

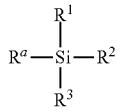

(Z)

(In formula (Z), $R^a$ denotes an organic functional group. $R^1$, $R^2$ and $R^3$ each independently denote a halogen atom, a hydroxyl group, an acetoxy group or an alkoxy group (preferably having from 1 to 3 carbon atoms.)

$R^a$ is an organic functional group and is not particularly limited, but preferred examples thereof include a hydrocarbon group (and preferably an alkyl group) having from 1 to 6 (preferably from 1 to 3, and more preferably 1 or 2) carbon atoms and an aryl group (and preferably a phenyl group).

$R^1$, $R^2$ and $R^3$ are each independently a halogen atom, a hydroxyl group, an acetoxy group or an alkoxy group. These are reactive groups, and form a crosslinked structure through hydrolysis, addition polymerization and condensation. In addition, hydrolysis, addition polymerization and condensation of $R^1$, $R^2$ and $R^3$ can be controlled by adjusting the reaction temperature, the reaction time, the reaction solvent and the pH. An organosilicon compound having three reactive groups ($R^1$, $R^2$ and $R^3$) per molecule other than $R^a$, as in formula (Z), is also known as a trifunctional silane.

Examples of compounds represented by formula (Z) include those listed below.

Trifunctional methylsilanes such as p-styryltrimethoxysilane, methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane and methyldiethoxyhydroxysilane; trifunctional ethylsilanes such as ethyltrimethoxysilane, ethyltriethoxysilane, ethyltrichlorosilane, ethyltriacetoxysilane and ethyltrihydroxysilane; trifunctional propylsilanes such as propyltrimethoxysilane, propyltriethoxysilane, propyltrichlorosilane, propyltriacetoxysilane and propyltrihydroxysilane; trifunctional butylsilanes such as butyltrimethoxysilane, butyltriethoxysilane, butyltrichlorosilane, butyltriacetoxysilane and butyltrihydroxysilane; trifunctional hexylsilanes such as hexyltrimethoxysilane, hexyltriethoxysilane, hexyltrichlorosilane, hexyltriacetoxysilane and hexyltrihydroxysilane; and trifunctional phenylsilanes such as phenyltrimethoxysilane, phenyltriethoxysilane, phenyltrichlorosilane, phenyltriacetoxysilane and phenyltrihydroxysilane. It is possible to use one of these organosilicon compounds in isolation, or a combination of two or more types thereof.

In addition, the compounds listed below may additionally be used together with the organosilicon compound having a structure represented by formula (Z). Organosilicon compounds having four reactive groups per molecule (tetrafunctional silanes), organosilicon compounds having two reactive groups per molecule (difunctional silanes) and organosilicon compounds having one reactive group per molecule (monofunctional silanes). Examples of these include the compounds listed below.

Trifunctional vinylsilanes such as dimethyldimethoxysilane, dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane and vinyldiethoxyhydroxysilane.

The content of a structure represented by formula (Z) in the monomers that form the organosilicon polymer is preferably 50 mol % or more, and more preferably 60 mol % or more.

The number average particle diameter of the external additive A is preferably from 30 nm to 300 nm, and more preferably from 50 nm to 200 nm.

In cases where this number average particle diameter is 30 nm or more, an interface where the toner particle is in contact with the external additive A is sufficiently broad, and embedding of the external additive A into the toner particle surface is effectively suppressed. In cases where this number average particle diameter is 300 nm or less, a sufficient number of rotations is achieved when the external additive A rolls over the toner particle surface for a certain distance, meaning that the surface of the external additive A can be uniformly charged and migration of the external additive A can be effectively suppressed.

In addition, the content of the external additive A in the toner is preferably from 0.10 parts by mass to 6.00 parts by mass, more preferably from 0.50 parts by mass to 2.50 parts by mass, and further preferably from 1.50 parts by mass to 2.20 parts by mass, relative to 100 parts by mass of the toner particle.

In cases where this content is 0.10 parts by mass or more, the external additive A can better impart the toner with fluidity. In cases where this content is 6.00 parts by mass or less, the amount of the external additive A relative to the toner particle is a suitable amount, it is possible to suppress occurrence of the external additive A remaining without being fixed, and it is possible to suppress initial image streaks and image fogging.

It is possible to use well-known means for externally adding and fixing the external additive A to the toner particle surface. For example, it is possible to use a Henschel mixer.

As long as the advantageous effect mentioned above is not impaired, fine particles other than the external additive A can, if necessary, be additionally used in the toner. By constituting in this way, it is possible to control, for example, fluidity, chargeability, cleaning performance, and the like.

In addition to silica fine particles, examples of external additives include inorganic oxide fine particles comprising alumina fine particles, titanium oxide fine particles, and the like; fine particles of inorganic stearic acid compounds, such as aluminum stearate fine particles and zinc stearate fine particles; and fine particles of inorganic titanate compounds such as strontium titanate and zinc titanate.

As silica fine particles, it is possible to use both dry silica fine particles known as fumed silica, which are produced through vapor phase oxidation of a silicon halide, and wet silica fine particles produced from water glass or the like.

In addition, the dry silica fine particles may be composite fine particles of silica and another metal oxide, which are produced by using another metal halide such as aluminum chloride or titanium chloride together with a silicon halide in a production process.

These inorganic fine particles are preferably surface treated using a silane coupling agent, a titanium coupling agent, a higher fatty acid, a silicone oil, a silicone varnish, a variety of modified silicone varnishes, or the like. It is possible to use one of these surface treatment agents in isolation, or a combination of two or more types thereof. By constituting in this way, it is possible to adjust the charge amount of the toner and improve heat-resistant storage properties and environmental stability.

The total added amount of external additives other than the external additive A is preferably from 0.05 parts by mass to 10.00 parts by mass, and more preferably from 0.1 parts by mass to 5.0 parts by mass, relative to 100 parts by mass of toner particles. It is possible to use one of these external additives other than the external additive A in isolation, or a combination of two or more types thereof.

The binder resin will now be discussed.

The toner may include a binder resin. The binder resin is not particularly limited, and a well-known binder resin can be used.

The following are examples: homopolymers of aromatic vinyl compounds and their substituted forms, e.g., styrene and vinyltoluene; copolymers of aromatic vinyl compounds, e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; homopolymers of aliphatic vinyl compounds and their substituted forms, e.g., ethylene and propylene; vinyl resins such as polyvinyl acetate, polyvinyl propionate, polyvinyl benzoate, polyvinyl butyrate, polyvinyl formate, and polyvinyl butyral; vinyl ether resins; vinyl ketone resins; acrylic polymers; methacrylic polymers; silicone resins; polyester resins; polyamide resins; epoxy resins; phenolic resins; rosin; modified rosin; and terpene resins. A single one of these may be used by itself or a combination of a plurality may be used.

Vinyl-based copolymers of the aromatic vinyl compounds, acrylic polymerizable monomers and methacrylic polymerizable monomers, and the like, listed below can be used in the copolymer of an aromatic vinyl compound.

The aromatic vinyl compounds and their substituted forms can be exemplified by the following:

styrene and styrene derivatives, e.g., styrene, α-methylstyrene, β-methylstyrene, o-methyl styrene, m-methyl styrene, p-methyl styrene, 2,4-dimethyl styrene, p-n-butylstyrene, p-tert-butylstyrene, p-n-hexylstyrene, p-n-octylstyrene, p-n-nonylstyrene, p-n-decylstyrene, p-n-dodecyl styrene, p-methoxystyrene, and p-phenyl styrene.

The polymerizable monomer for formation of acrylic polymers can be exemplified by acrylic polymerizable monomers, e.g., acrylic acid, methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate.

The polymerizable monomer for formation of methacrylic polymers can be exemplified by methacrylic polymerizable monomers, e.g., methacrylic acid, methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Condensation polymers between the hereafter-exemplified carboxylic acid components and alcohol components can be used as the polyester resin. The carboxylic acid component can be exemplified by terephthalic acid, isophthalic acid, phthalic acid, fumaric acid, maleic acid, cyclohexanedicarboxylic acid, and trimellitic acid. The alcohol component can be exemplified by bisphenol A, hydrogenated bisphenols, ethylene oxide adducts on bisphenol A, propylene oxide adducts on bisphenol A, glycerol, trimethylolpropane, and pentaerythritol.

The polyester resin may be a urea group-containing polyester resin. Preferably the carboxy groups, e.g., in terminal position and so forth, of the polyester resin are not capped.

The binder resin may have polymerizable functional groups with the goal of enhancing the viscosity change of the toner at high temperatures. The polymerizable functional group can be exemplified by the vinyl group, isocyanate group, epoxy group, amino group, carboxy group, and hydroxy group.

Of these, the binder resin is preferably a styrene-(meth) acrylic-based copolymer such as a styrene-alkyl (meth) acrylic acid ester copolymer, such as a styrene-butyl acrylate copolymer, from perspectives such as developing characteristics and fixing performance. Moreover, the method for producing the polymer is not particularly limited, and a well-known method can be used.

In addition, the resin A can be used as the binder resin.

The wax will now be discussed.

The toner particle may contain a wax. There are no particular limitations on this was, and the following are examples: aliphatic hydrocarbon waxes such as low molecular weight polyethylene, low molecular weight polypropylene, microcrystalline wax, Fischer-Tropsch wax, and paraffin wax; the oxides of aliphatic hydrocarbon waxes, e.g., oxidized polyethylene wax, and their block copolymers; waxes in which the main component is a fatty acid ester, e.g., carnauba wax and montanic acid ester wax, and waxes provided by the partial or complete deacidification of a fatty acid ester, e.g., deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinyl monomer such as styrene or acrylic acid; partial esters between a fatty acid and a polyhydric alcohol, such as behenyl monoglyceride; and hydroxy group-containing methyl ester compounds obtained, e.g., by the hydrogenation of plant oils. A single one of these waxes may be used or a combination of two or more may be used.

Of these, use of an ester wax is preferred. By constituting in this way, the wax is readily exuded at the surface at the time of fixing, and wrapping around on a fixing roller is reduced. This is due to a C═O segment in the resin A having a similar polarity to a C═O segment in the ester wax.

Because the resin A exhibits high affinity for the ester wax, the ester wax, which melts when the toner is fixed, exhibits affinity for the resin A present near the toner particle surface and gathers near the toner particle surface, thereby improving releasability.

Furthermore, when the resin A melts at the time of fixing, affinity of the resin A is high for a silicon-containing spherical external additive, meaning that the spherical external additive is readily embedded into the inner part of the toner particle surface. At this point, exudation of the ester wax to the toner particle surface is further facilitated. Therefore, by using a silicon-containing spherical external additive at the toner particle surface, the advantageous effect of release from a fixing roller is significantly increased.

The ester wax is preferably an ester compound of an aliphatic monoalcohol having 6 to 26 (and preferably 18 to 24) carbon atoms and an aliphatic monocarboxylic acid having 6 to 26 (and preferably 18 to 24) carbon atoms.

In addition, use of an aliphatic hydrocarbon wax such as a Fischer Tropsch wax is preferred.

The aliphatic alcohol for ester wax formation can be exemplified by 1-hexanol, 1-heptanol, 1-octanol, 1-nonanol, 1-decanol, undecyl alcohol, lauryl alcohol, myristyl alcohol, 1-hexadecanol, stearyl alcohol, arachidyl alcohol, behenyl alcohol, and lignoceryl alcohol. The aliphatic carboxylic acids can be exemplified by pentanoic acid, hexanoic acid, heptanoic acid, octanoic acid, nonanoic acid, decanoic acid, lauric acid, myristic acid, palmitic acid, stearic acid, arachidic acid, behenic acid, and lignoceric acid.

The wax content, considered per 100.0 mass parts of the binder resin or polymerizable monomer, is preferably from 0.5 mass parts to 30.0 mass parts.

The colorant will now be discussed.

The toner may include a colorant. The colorant is not particularly limited, and known colorants can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180.

Examples of orange pigments are presented below.

Permanent Orange GTR, Pyrazolone Orange, Vulcan Orange, Benzidine Orange G, Indanthrene Brilliant Orange RK, and Indathrene Brilliant Orange GK.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, perylene compounds. Specific examples are presented hereinbelow.

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, 66.

Examples of purple pigments include Fast Violet B and Methyl Violet Lake.

Examples of green pigments include Pigment Green B, Malachite Green Lake, and Final Yellow Green G. Examples of white pigments include zinc white, titanium oxide, antimony white and zinc sulfide.

Examples of black pigments include carbon black, aniline black, non-magnetic ferrites, magnetite, and those which are colored black by using the abovementioned yellow colorant, red colorant and blue colorant. These colorants can be used singly or in a mixture, or in the form of a solid solution.

If necessary, the colorant may be surface-treated with a substance which does not inhibit polymerization.

The amount of the colorant is preferably from 1.0 parts by mass to 15.0 parts by mass with respect to 100.0 parts by mass of the binder resin or the polymerizable monomer.

The charge control agent will now be discussed.

The toner particle may contain a charge control agent. A known charge control agent can be used as this charge control agent, while a charge control agent that provides a fast triboelectric charging speed and that can maintain a defined and stable triboelectric charge amount is preferred. When the toner particle is produced by a polymerization method, a charge control agent that exercises little polymerization inhibition and that is substantially free of material soluble in the aqueous medium is preferred.

Charge control agents comprise charge control agents that control toner to negative charging and charge control agents that control toner to positive charging.

The following are examples of charge control agents that control toner to negative charging:

monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and resin-type charge control agents.

The following, on the other hand, are examples of charge control agents that control toner to positive charging:

nigrosine and nigrosine modifications by, e.g., fatty acid metal salts; guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and resin-type charge control agents.

A single one of these charge control agents may be used or combinations of two or more may be used. Among these charge control agents, metal-containing salicylic acid compounds are preferred and metal-containing salicylic acid compounds in which the metal is aluminum or zirconium are particularly preferred.

The amount of addition of the charge control agent, per 100.0 mass parts of the binder resin, is preferably from 0.1 mass parts to 20.0 mass parts and is more preferably from 0.5 mass parts to 10.0 mass parts.

In addition, it is preferable to use a polymer or copolymer having a sulfonic acid group, a sulfonic acid salt group or a sulfonic acid ester group as the charge control resin.

It is particularly preferable for a polymer having a sulfonic acid group, a sulfonic acid salt group or a sulfonic acid ester group to contain a sulfonic acid group-containing acrylamide-based monomer or a sulfonic acid group-containing methacrylamide-based monomer at a copolymerization ratio of 2 mass % or more. This copolymerization ratio is more preferably 5 mass % or more.

The charge control resin preferably has a glass transition temperature (Tg) of from 35° C. to 90° C., a peak molecular weight (Mp) of from 10,000 to 30,000, and a weight average molecular weight (Mw) of from 25,000 to 50,000.

In cases where this type of charge control resin is used, it is possible to impart preferred triboelectric chargeability without adversely affecting thermal characteristics required of the toner particle. Furthermore, because the charge control resin contains a sulfonic acid group, dispersibility of the charge control resin per se in the colorant-dispersed solution and dispersibility of the colorant are improved, and tinting strength, transparency and triboelectric chargeability can be further improved.

A method for producing the toner particle will now be discussed.

A known means can be used for the method of producing the toner particle. Examples here are dry production methods, i.e., kneading pulverization methods, and wet production methods, i.e., suspension polymerization methods, dissolution suspension methods, emulsion aggregation methods, and emulsion polymerization and aggregation methods. The use of a wet method is preferred from the standpoints of sharpening the particle size distribution of the toner particle, improving the average circularity of the toner particle, and generating a core-shell structure.

For example, when the toner particle is produced by a kneading pulverization method, the resin A and optionally a binder resin, wax, colorant, charge control agent, and other additives are thoroughly mixed using a mixer, e.g., a Henschel mixer, ball mill, and so forth. After this, the toner particle is obtained by melt-kneading using a heated kneader, such as a hot roll, kneader, or extruder, to disperse or dissolve the various materials, and by a cooling and solidification step, a pulverization step, a classification step, and optionally a surface treatment step.

A known pulverization apparatus, e.g., a mechanical impact system, jet system, and so forth, may be used in the pulverization step. With regard to the sequence of the classification step and the surface treatment step, either may go before the other. The classification step preferably uses a multi-grade classifier based on productivity considerations.

Toner particle production by the suspension polymerization method, which is a wet production method, is described in the following.

Detailed explanations will now be given of toner particle production example in which suspension polymerization method is used, but embodiments are not limited to these. The toner particle is preferably a toner particle produced using suspension polymerization.

In the suspension polymerization method, the resin A and the polymerizable monomer for formation of the binder resin are dissolved or dispersed to uniformity using a disperser such as a ball mill or ultrasound disperser to obtain a polymerizable monomer composition (step of preparing a polymerizable monomer composition).

This polymerizable monomer can be exemplified by the polymerizable monomers provided as examples of the polymerizable monomer for formation of the aforementioned vinyl copolymers. Wax, colorant, charge control agent, crosslinking agent, polymerization initiator, and other additives may be added on an optional basis to the polymerizable monomer composition.

A crosslinking agent may be added on an optional basis during polymerization of the polymerizable monomer in order to control the molecular weight of the binder resin. Mainly a compound having two or more polymerizable double bonds is used as the crosslinking agent. Examples are aromatic divinyl compounds such as divinylbenzene and divinylnaphthalene; carboxylate esters containing two double bonds, such as ethylene glycol diacrylate, diethylene glycol diacrylate, triethylene glycol diacrylate, tetraethylene glycol diacrylate, neopentyl glycol diacrylate, 1,3-butanediol diacrylate, 1,3-butylene glycol diacrylate, 1,4-butanediol diacrylate, 1,5-pentanediol diacrylate, 1,6-hexanediol diacrylate, the diacrylates of polyethylene glycol #200, #400, and #600, dipropylene glycol diacrylate, polypropylene glycol diacrylate, polyester-type diacrylates (MANDA, Nippon Kayaku Co., Ltd.), and crosslinking agents provided by changing the acrylate in the preceding to methacrylate; divinyl compounds such as divinylaniline, divinyl ether, divinyl sulfide, and divinyl sulfone; and compounds having three or more vinyl groups. A single one of these may be used or a mixture of two or more may be used.

The amount of addition of the crosslinking agent is preferably from 0.1 mass parts to 15.0 mass parts per 100 mass parts of the polymerizable monomer.

The polymerizable monomer composition is then introduced into a previously prepared aqueous medium and droplets of the polymerizable monomer composition are formed in the desired toner particle size using a high-shear stirrer or a disperser (granulation step).

The aqueous medium in the granulation step preferably contains a dispersion stabilizer in order to suppress toner particle coalescence during the production sequence, control the particle size of the toner particle, and sharpen the particle size distribution.

The dispersion stabilizers can be generally categorized into polymers, which generate a repulsive force through steric hindrance, and sparingly water-soluble inorganic compounds, which support dispersion stabilization through an electrostatic repulsive force. Fine particles of a sparingly water-soluble inorganic compound, because they can be dissolved by acid or alkali, are advantageously used because they can be easily removed by dissolution by washing with acid or alkali after polymerization.

When the dispersion stabilizer is a sparingly water-soluble inorganic compound, the use is preferred of a dispersion stabilizer that contains any of the following: magnesium, calcium, barium, zinc, aluminum, and phosphorus. The dispersion stabilizer more preferably contains any of the following: magnesium, calcium, aluminum, and phosphorus. Specific examples are as follows.

magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite. When such a sparingly water-soluble inorganic dispersing agent is used, it may be used as such, or, in order to obtain even finer particles, use may be made of inorganic dispersing agent particles that have been produced in the aqueous medium. Using the case of tricalcium phosphate as an example, an aqueous sodium phosphate solution may be mixed with an aqueous calcium chloride solution under high-speed stirring to produce water-insoluble calcium phosphate, thus enabling a more uniform and finer dispersion.

An organic compound, for example, polyvinyl alcohol, gelatin, methyl cellulose, methyl hydroxypropyl cellulose, ethyl cellulose, the sodium salt of carboxymethyl cellulose, and starch, may also be used in combination in said dispersion stabilizer. These dispersion stabilizers are preferably used at from 0.1 mass parts to 20.0 mass parts per 100 mass parts of the polymerizable monomer.

A surfactant may also be used at from 0.1 mass parts to 10.0 mass parts per 100 mass parts of the polymerizable monomer in order to microfine-size these dispersion stabilizers. Specifically, a commercial nonionic, anionic, or cationic surfactant can be used. For example, the use is preferred of sodium dodecyl sulfate, sodium tetradecyl sulfate, sodium pentadecyl sulfate, sodium octyl sulfate, sodium oleate, sodium laurate, potassium stearate, or calcium oleate.

The polymerizable monomer present in the polymerizable monomer composition is polymerized, after the granulation step or while carrying out the granulation step, with the temperature set preferably to from 50° C. to 90° C. to obtain a toner particle dispersion (polymerization step).

During the polymerization step, a stirring operation sufficient to provide a uniform temperature distribution in the vessel is preferably carried out. When a polymerization initiator is added, this addition may be carried out using any timing and for any required length of time. In addition, with the goal of obtaining a desired molecular weight distribution, the temperature may be raised in the latter half of the polymerization reaction, and, in order to remove, e.g., unreacted polymerizable monomer and by-products, from the system, a portion of the aqueous medium may be distilled off by a distillation process in the latter half of the reaction or after the completion of the reaction. The distillation process is carried out at normal pressure or under reduced pressure.

The polymerization initiator used in the suspension polymerization method preferably has a half-life in the polymerization reaction of from 0.5 hour to 30 hours. A polymer having a maximum between molecular weights of 5000 and 50000 can be obtained when the polymerization reaction is carried out using an amount of addition of from 0.5 mass parts to 20 mass parts per 100 mass parts of the polymerizable monomer. Oil-soluble initiators are generally used as the polymerization initiator. The following are examples.

azo compounds, e.g., 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile, and peroxide initiators such as acetyl cyclohexylsulfonyl peroxide, diisopropyl peroxycarbonate, decanoyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A water-soluble initiator may be co-used on an optional basis for the polymerization initiator, and examples thereof are as follows:

ammonium persulfate, potassium persulfate, 2,2'-azobis(N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrilesulfonate, ferrous sulfate, or hydrogen peroxide.

A single one of these polymerization initiators may be used by itself or two or more may be used in combination. A chain transfer agent, polymerization inhibitor, and so forth may also be added and used in order to control the degree of polymerization of the polymerizable monomer.

The particle diameter of the toner particle is preferably a weight-average particle diameter of from 3.0 μm to 10.0 μm from the standpoint of obtaining a high-definition and high-resolution image. The weight-average particle diameter of the toner particle can be measured using the pore electrical resistance method. For example, measurement can be performed using a "Coulter Counter Multisizer 3" (Beckman Coulter, Inc.).

The toner particle dispersion provided by going through the polymerization step is transferred to a filtration step that performs solid-liquid separation of the toner particle from the aqueous medium.

The solid-liquid separation for obtaining the toner particle from the resulting toner particle dispersion can be carried out using an ordinary filtration method. This is preferably following by additional washing by, e.g., reslurrying or washing with wash water, in order to remove foreign material that could not previously be removed from the toner particle surface.

After thorough washing has been carried out, a toner cake is obtained by carrying out another solid-liquid separation. The toner particle is subsequently obtained by drying using a known drying means and as necessary separating out, by classification, particle fractions that have a non-spec particle diameter. When this is done, the separated particle fractions having a non-spec particle diameter may be re-used in order to improve the final yield.

The toner can be used as a magnetic or nonmagnetic one-component developer, but it may be also mixed with a carrier and used as a two-component developer.

As the carrier, magnetic particles composed of conventionally known materials such as metals such as iron, ferrites, magnetite and alloys of these metals with metals such as aluminum and lead can be used. Among them, ferrite particles are preferable. Further, a coated carrier obtained by coating the surface of magnetic particles with a coating agent such as a resin, a resin dispersion type carrier obtained by dispersing magnetic fine powder in a resin, or the like may be used as the carrier.

The volume average particle diameter of the carrier is preferably from 15 μm to 100 μm, and more preferably from 25 μm to 80 μm.

The methods used to measure the properties pertaining to the toner are described in the following.

Methods for Measuring Shape Factor SF-1 and SF-2 and Number Average Particle Diameter of External Additive A The shape factor SF-1 and SF-2 of the external additive A are calculated in the manner described below by observing the toner, to which the external additive has been externally added, using an S-4800 scanning electron microscope (SEM) produced by Hitachi, Ltd.

In a field of view magnified 100,000 to 200,000 times, the maximum length, peripheral length and area of the external additive are measured using Image-Pro Plus 5.1J image editing software (produced by MediaCybernetics).

SF-1 and SF-2 are calculated using the formula below. Average values for 100 external additive measurements are determined in this way, and these average values are taken to be SF-1 and SF-2 of the external additive.

$$SF\text{-}1=(\text{maximum length of external additive})^2/\text{area of external additive}\times\pi/4\times100$$

$$SF\text{-}2=(\text{peripheral length of external additive})^2/\text{area of external additive}\times100/4\pi$$

In addition, an average value is determined for 100 external additive samples having maximum lengths similar to that of the external additive A, and this average value is taken to be the number average particle diameter.

Means for differentiating organosilicon polymer fine particles and silica fine particles in the toner will now be discussed.

Method for Extracting the Resin A from the Toner Particle

Extraction of the resin A in the toner particle is carried out by performing separation by solvent gradient elution on an extract obtained using tetrahydrofuran (THF). The preparative method is given in the following.

10.0 g of the toner particle is weighed out and is introduced into an extraction thimble (No. 84, Toyo Rosha Kaisha, Ltd.), and this is set into a Soxhlet extractor. Extraction is performed for 20 hours using 200 mL of THF as the solvent, and the solvent is then removed from the extract to yield a solid that is the THF-soluble matter. Resin A is contained in the THF-soluble matter. This procedure is performed a plurality of times to obtain the required amount of THF-soluble matter.

Gradient preparative HPLC (LC-20AP High-Performance Gradient Preparative System, Shimadzu Corporation; 50 mmϕ, ×250 mm SunFire Preparative Column, Waters Corporation) is used for the solvent gradient elution procedure. The following are used: 30° C. for the column temperature, 50 mL/min for the flow rate, acetonitrile for the poor solvent in the mobile phase, and THF for the good solvent. 0.02 g of the THF-soluble matter yielded by the extraction is dissolved in 1.5 mL of THF and this is used as the sample for separation. A composition with 100% acetonitrile is used for the starting mobile phase; then, when 5 minutes have elapsed after sample injection, the percentage of THF is increased by 4% each minute; and the mobile phase composition at 25 minutes is 100% THF. Components can be separated by drying the obtained fractions to solidification. The resin A can thereby be obtained. Which fraction components are resin A can be determined by measurement of the silicon atom content and $^{13}$C-NMR measurement as described below.

Method for Measuring the Silicon Atom Content in the Resin A

An "Axios" wavelength-dispersive x-ray fluorescence analyzer (PANalytical B.V.) is used for the silicon atom content in the resin A. The "SuperQ ver. 4.0F" (PANalytical B.V.) software provided therewith is used in order to set the measurement conditions and analyze the measurement data.

Rh is used for the x-ray tube anode, and 24 kV and 100 mA are used, respectively, for the acceleration voltage and current.

A vacuum is used for the measurement atmosphere; 27 mm is used for the measurement diameter (collimator diameter); and 10 seconds is used for the measurement time. A proportional counter (PC) is used for the detector. The measurement is carried out using PET for the analyzing crystal; the count rate (unit: cps) of Si-Kα radiation observed at a diffraction angle (2θ)=109.08° is measured; and the determination is made using a calibration curve as described in the following.

The resin A may be used as such as the measurement sample, or the resin extracted from the toner particle using the aforementioned extraction method may be used as the measurement sample.

A "BRE-32" tablet compression molder (Maekawa Testing Machine Mfg. Co., Ltd.) is used to obtain the measurement pellet. 4 g of the measurement sample is introduced into a specialized aluminum compaction ring and is smoothed over, and a pellet is produced by molding to a thickness of 2 mm and a diameter of 39 mm by compression for 60 seconds at 20 MPa, and this pellet is used as the measurement pellet.

With regard to the pellets for construction of the calibration curve for the determination of content, $SiO_2$ (hydrophobic fumed silica) [product name: AEROSIL NAX50, specific surface area: 40±10 ($m^2$/g), carbon content: 0.45 to 0.85%, from Nippon Aerosil Co., Ltd.] is added at 0.5 mass parts per 100 mass parts of a binder [product name: Spectro Blend, components: C 81.0, O 2.9, H 13.5, N 2.6 (mass %), chemical formula: $C_{19}H_{38}O$ N, form: powder (44 μm), from the Rigaku Corporation]; thorough mixing is performed in a coffee mill; and a pellet is prepared by pellet molding. The same mixing and pellet molding procedure is used to prepare pellets using the $SiO_2$ at 5.0 mass parts and 10.0 mass parts, respectively.

A calibration curve in the form of a linear function is obtained by placing the obtained x-ray count rate on the vertical axis and the Si addition concentration for each calibration curve sample on the horizontal axis.

The count rate for Si-Kα radiation is then also measured for the measurement sample using the same procedure. The silicon atom content (mass %) is determined from the calibration curve that has been prepared.

Identification of the Structure of Resin A

Structural confirmation of the macromolecular segment $P^1$, the $L^1$ segment, and the $R^1$ to $R^3$ segments in resin A is performed using $^1$H-NMR analysis, $^{13}$C-NMR analysis, $^{29}$Si-NMR analysis, and FT-IR analysis.

The resin A may be used as such as the measurement sample, or the resin A extracted from the toner particle using the aforementioned extraction method may be used as the measurement sample.

When $L^1$ contains an amide bond as represented by formula (2), identification can be carried out by $^1$H-NMR analysis. Specifically, identification can be carried out using the chemical shift value for the proton in the NH segment in the amide group, and the amount of amide group can be determined by calculation of the integration value.

In addition, when the $R^1$ to $R^3$ in the resin represented by formula (1) contains an alkoxy group or hydroxy group, the valence with respect to the silicon atom of the alkoxy group or hydroxy group can be determined by the method described below under "Measurement Conditions for $^{29}$Si-NMR (Solid State)".

Measurement Conditions for $^{29}$Si-NMR (Solid State)

instrument: JNM-ECX500II, JEOL Resonance, Inc.

sample tube: 3.2 mmϕ, sample size: 150 mg measurement temperature: room temperature
pulse mode: CP/MAS
measurement nucleus frequency: 97.38 MHz ($^{29}Si$)
reference substance: DSS (external reference: 1.534 ppm)
sample spinning rate: 10 kHz
contact time: 10 ms
delay time: 2 s
number of scans: 2000 to 8000

This measurement makes it possible to obtain the abundance by peak separation/integration by curve fitting for the multiple silane components depending on the number of oxygen atoms bonded to the Si. Proceeding in this manner makes it possible to identify the valence with respect to the silicon atom of the alkoxy group or hydroxy group of the $R^1$ to $R^3$ in the resin given by formula (1).

The structures of $P^1$, $L^1$, and $R^1$ to $R^3$ in the resin A represented by formula (1) can be determined by $^{13}C$-NMR (solid state) measurement. The measurement conditions are as follows.

Measurement Conditions for $^{13}C$-NMR (Solid State)
instrument: JNM-ECX500II, JEOL Resonance, Inc.
sample tube: 3.2 mmϕ,
sample size: 150 mg
measurement temperature: room temperature
pulse mode: CP/MAS
measurement nucleus frequency: 123.25 MHz ($^{13}C$)
reference substance: adamantane (external reference: 29.5 ppm)
sample spinning rate: 20 kHz
contact time: 2 ms
delay time: 2 s
number of scans: 1024

Separation into various peaks depending on the species of $P^1$, $L^1$, and $R^1$ to $R^3$ in formula (1) is performed and each are identified to determine the species of $P^1$, $L^1$, and $R^1$ to $R^3$.

Method for Evaluating Resin A Present at Toner Particle Surface

Whether or not the resin A is present at a toner particle surface is confirmed by time of flight secondary ion mass spectrometry (TOF-SIMS). Equipment used and measurement conditions are as follows.

Measurement apparatus: nanoTOF II (product name, produced by Ulvac-Phi)
Primary ion type: $Bi_3^{++}$
Accelerating voltage: 30 kV
Primary ion current: 0.05 pA
Repetition frequency: 8.2 kHz
Raster mode: Unbunch
Raster size: 50 μm×50 μm, 256×256 pixels
Measurement mode: Positive
Neutralizing electron gun: used
Measurement time: 600 seconds
Sample preparation: fixing toner particle on indium sheet
Sample pretreatment: none
Reference sample for identification: resin A per se or resin A extracted from toner particle using the extraction method mentioned above.

By imaging the toner particle surface at mass numbers for Si ions and fragment ions derived from the resin A using standard software (TOF-DR) produced by Ulvac-Phi, it is possible to confirm that the resin A is present in a region where the toner particle surface is exposed.

Method for Measuring the Number Average Molecular Weight (Mn) and the Weight Average Molecular Weight (Mw)

The weight average molecular weight (Mw) and number average molecular weight (Mn) of the polymer, resin or toner particle are measured as follows using gel permeation chromatography (GPC).

First, the sample is dissolved in tetrahydrofuran (THF) for 24 hours at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

instrument: HLC8120 GPC (detector: RI) (Tosoh Corporation)
column: 7-column train of Shodex KF-801, 802, 803, 804, 805, 806, and 807 (Showa Denko Kabushiki Kaisha)
eluent: tetrahydrofuran (THF)
flow rate: 1.0 mL/min
oven temperature: 40.0° C.
amount of sample injection: 0.10 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Evaluation of Structure of Organosilicon Polymer Fine Particles

Solid pyrolysis gas chromatography mass spectrometry (hereinafter referred to as pyrolysis GC/MS) and NMR are used for determining the ratio of the peak area of T3 unit structures (formula (A3)) in the organosilicon polymer fine particles contained in the toner and for identification of Rm in formula (A3).

In cases where the toner contains silica fine particles in addition to organosilicon polymer fine particles, 1 g of toner is placed in a vial and dissolved and dispersed in 31 g of chloroform. A dispersed solution is prepared by treating for 30 minutes with an ultrasonic wave type homogenizer in order to effect dispersion.

ultrasound treatment instrument: VP-050 ultrasound homogenizer (TIETECH Co., Ltd.)
microtip: stepped microtip, 2 mmϕ, end diameter
position of microtip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. Following the centrifugal separation, Si-containing substances other than the organosilicon polymer are contained in the lower layer in the glass tube. A sample is produced by extracting the chloroform solution containing Si-containing substances derived from the organosilicon polymer in the upper layer and removing the chloroform by vacuum drying (for 24 hours at 40° C.).

Using the sample obtained by the above or organosilicon polymer fine particles, the abundance of the constituent compounds of the organosilicon polymer fine particles and proportion for the T3 unit structure in the organosilicon polymer fine particles is then measured and calculated using solid state $^{29}Si$-NMR.

Pyrolysis GC/MS is used for analysis of the species of constituent compounds of the organosilicon polymer particles.

Pyrolysis product components derived from the organosilicon polymer fine particles, which are produced when the organosilicon polymer fine particles are pyrolyzed at approximately 550° C. to 700° C., are measured by means of mass spectrometry, and by analyzing decomposition peaks, it is possible to identify species of compounds that constitute the organosilicon polymer fine particles.

Measurement Conditions for Pyrolysis GC/MS pyrolysis instrument: JPS-700 (Japan Analytical Industry Co., Ltd.)

pyrolysis temperature: 590° C.

GC/MS instrument: Focus GC/ISQ (Thermo Fisher)

column: HP-SMS, 60 m length, 0.25 mm inner diameter, 0.25 μm film thickness injection port temperature: 200° C.

flow pressure: 100 kPa

Split: 50 mL/min

MS ionization: EI

Ion source temperature: 200° C., Mass Range: 45 to 650

The abundance of the identified constituent compounds of the organosilicon polymer fine particles is then measured and calculated using solid state $^{29}$Si-NMR. In solid state $^{29}$Si-NMR, peaks are detected in different shift regions depending on the structure of the functional groups bonded to the Si in the constituent compounds of the organosilicon polymer particles.

By specifying peak positions using a standard sample, it is possible to specify structures bonded to Si. In addition, the abundance ratio of constituent compounds can be calculated from obtained peak areas. The ratio of the peak area of a T3 unit structure relative to the total peak area can be determined through calculations.

Solid state $^{29}$Si-NMR measurement conditions are, for example, as follows. apparatus: JNM-ECX500II produced by JEOLRESONANCE measurement temperature: room temperature measurement method: DDMAS method, $^{29}$Si, 45° sample tube: zirconia 3.2 mmϕ sample: filled in powder form into the sample tube sample rotation rate: 10 kHz relaxation delay: 180 s number of scans: 2,000

After this measurement, peak separation is performed, for the organosilicon polymer, into the following structure X1, structure X2, structure X3, and structure X4 by curve fitting for silane components having different substituents and bonding groups, and their respective peak areas are calculated.

The structure X3 indicated below is the T3 unit structure.

structure X1: $(Ri)(Rj)(Rk)SiO_{1/2}$ (A1)

structure X2: $(Rg)(Rh)Si(O_{1/2})_2$ (A2)

structure X3: $RmSi(O_{1/2})_3$ (A3)

structure X4: $Si(O_{1/2})_4$ (A4)

X1

(A1)

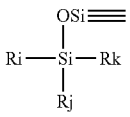

X2

(A2)

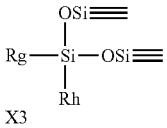

X3

-continued (A3)

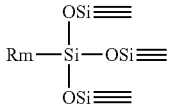

X4

(A4)

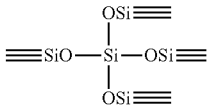

In addition, the organic group represented by $R^a$ is confirmed by $^{13}$C-NMR.

Measurement Conditions for $^{13}$C-NMR (Solid State)

apparatus: JNM-ECX500II from JEOL RESONANCE, Inc.

sample tube: zirconia 3.2 mmϕ sample: filled in powder form into the sample tube measurement temperature: room temperature pulse mode: CP/MAS measurement nucleus frequency: 123.25 MHz ($^{13}$C)

reference material: adamantane (external reference: 29.5 ppm)

sample rotation rate: 20 kHz contact time: 2 ms retardation time: 2 s number of scans: 1024

In this method, the hydrocarbon group represented by $R^a$ is confirmed by the presence/absence of a signal originating with, e.g., the silicon atom-bonded methyl group (Si—$CH_3$), ethyl group (Si—$C_2H_5$), propyl group (Si—$C_3H_7$), butyl group (Si—$C_4H_9$), pentyl group (Si—$O_5H_{11}$), hexyl group (Si—$C_6H_{13}$), or phenyl group (Si—$C_6H_5$).

Method for Measuring Content of Organosilicon Polymer Fine Particles Contained in Toner The content of organosilicon polymer fine particles contained in the toner can be determined using the following method. 1 g of toner is placed in a vial and dissolved and dispersed in 31 g of chloroform. A dispersed solution is prepared by treating for 30 minutes with an ultrasonic wave type homogenizer in order to effect dispersion. ultrasonic wave treatment apparatus: VP-050 ultrasonic wave type homogenizer (available from Taitec Corporation)

microchip: stepped microtip, 2 mmϕ, end diameter position of microtip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersed solution is transferred to a (50 mL) swing rotor glass tube and subjected to centrifugal separation for 30 minutes at a rate of 58.33 $S^{-1}$ using a centrifugal separator (H-9R, available from Kokusan Co., Ltd.). Following the centrifugal separation, organosilicon polymer fine particles in the glass tube are separated. These are extracted and dispersed again in 10 g of chloroform for washing, and the organosilicon polymer fine particles are separated using a centrifugal separator. After carrying out the washing procedure again, the extracted organosilicon polymer fine particles are subjected to vacuum drying (for 24 hours at 40° C.) so as to remove the chloroform and isolate the organosilicon polymer fine particles.

By measuring the weight of the isolated sample, it is possible to determine the content of the organosilicon polymer fine particles in the toner.

Moreover, in cases where the toner contains another external additive, such as silica fine particles, in addition to the organosilicon polymer fine particles, this can be separated by means of difference in specific gravity by carrying out the centrifugal separation mentioned above. In addition, by carrying out the ultrasonic wave treatment and centrifugal separation mentioned above, it is possible to obtain a toner particle from which the external additive has been removed. The obtained toner particle can be used in a variety of analyses.

In cases where it is difficult to separate the organosilicon polymer fine particles by means of specific gravity, the content can be determined by determining the volume ratios of various particles in the separated mixture. SEM-EDX is used to determine the volume ratio of the particles in the separated mixture. Moreover, in the case of particles having similar compositions, such as organosilicon polymer fine particles and silica fine particles, the organosilicon polymer fine particles and silica fine particles are differentiated by SEM-EDX. This method is described later.

Method for Measuring Content of Silica Fine Particles Contained in Toner

The content of silica fine particles contained in the toner can be determined using the following method.

1 g of toner is placed in a vial and dissolved and dispersed in 31 g of chloroform. A dispersed solution is prepared by treating for 30 minutes with an ultrasonic wave type homogenizer in order to effect dispersion. ultrasonic wave treatment apparatus: VP-050 ultrasonic wave type homogenizer (available from Taitec Corporation)

microchip: stepped microtip, 2 mmϕ end diameter position of microtip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersed solution is transferred to a (50 mL) swing rotor glass tube and subjected to centrifugal separation for 30 minutes at a rate of 58.33 $S^{-1}$ using a centrifugal separator (H-9R, available from Kokusan Co., Ltd.). Following the centrifugal separation, silica fine particles in the glass tube are separated. These are extracted and dispersed again in 10 g of chloroform for washing, and the silica fine particles are separated using a centrifugal separator. After carrying out the washing procedure again, the extracted silica fine particles are subjected to vacuum drying (for 24 hours at 40° C.) so as to remove the chloroform and isolate the silica fine particles.

By measuring the weight of the isolated sample, it is possible to determine the content of the silica fine particles in the toner.

Moreover, means for differentiating the organosilicon polymer fine particles and the silica fine particles is as follows.

Identification of Organosilicon Polymer Fine Particles and Silica Fine Particles In cases where the toner contains organosilicon polymer fine particles and silica fine particles, these can be differentiated using the following method.

It is possible to use a combination of shape observations using SEM and elemental analysis using EDX as a method for identifying organosilicon polymer fine particles and silica fine particles contained in the toner.

The toner is observed in a field of view magnified a maximum of 50,000 times using a S-4800 scanning electron microscope (produced by Hitachi, Ltd.). The microscope is focused on the toner particle surface, and the external additive is observed. Particles of the external additive are subjected to EDX analysis, and whether or not analyzed particles are organosilicon polymer fine particles is assessed by the presence/absence of Si element peaks.

In cases where the toner contains both organosilicon polymer fine particles and silica fine particles, organosilicon polymer fine particles are identified by comparing the ratio (Si/O ratio) of Si and O element content values (atomic %). Standard samples of organosilicon polymer fine particles and silica fine particles are subjected to EDS analysis under the same conditions, and Si and O element content values (atomic %) are obtained. The Si/0 ratio for the organosilicon polymer fine particles is denoted by A, and the Si/0 ratio for the silica fine particles is denoted by B. Measurement conditions are selected so that the value of A is significantly higher than the value of B. Specifically, measurements are carried out 10 times under the same conditions for the standard samples, and arithmetic mean values for A and B are obtained. Measurement conditions are selected so that obtained average values are such that AB>1.1.

In cases where the Si/0 ratio of fine particles to be differentiated is further towards A than [(A+B)/2], it is assessed that the fine particles in question are organosilicon polymer fine particles.

Tospearl 120A (produced by Momentive Performance Materials Inc.) is used as the standard sample of the organosilicon polymer fine particles, and HDK V15 (produced by Asahi Kasei Corporation) is used as the standard sample of the silica particles.

EXAMPLES

The present invention is more specifically described in the following using production examples and examples, but the present invention is in no way limited to or by these. Unless specifically indicated otherwise, the "parts" and "%" given in the examples and comparative examples are on a mass basis in all instances.

Synthesis of Polyester Resin (A-1)

Polyester resin (A-1) was synthesized using the following procedure.

The following materials were introduced into an autoclave fitted with a pressure reduction apparatus, water separation apparatus, nitrogen gas introduction apparatus, temperature measurement apparatus, and stirring apparatus and a reaction was run for 5 hours at 200° C. at normal pressure under a nitrogen atmosphere.

propylene oxide 2.0 mol adduct on bisphenol A: 77.4 parts terephthalic acid: 15.8 parts isophthalic acid: 15.8 parts maleic acid: none tetrabutoxytitanate: 0.2 parts This was followed by the addition of the following materials and reaction for 3 hours at 220° C.

trimellitic acid: 0.1 parts tetrabutoxytitanate: 0.3 parts

A reaction was carried out for a further 2 hours at a reduced pressure of 10 mmHg to 20 mmHg. Polyester resin (A-1) was obtained by dissolving the obtained resin in chloroform, adding this solution dropwise to ethanol, reprecipitating and filtering. The Mw value of the obtained polyester resin (A-1) was 10,200.

Synthesis of Polyester Resins (A-2) to (A-6)

Polyester resins (A-2) to (A-6) were obtained in the same way as in the synthesis of polyester resin (A-1), except that the 2.0 mol propylene oxide adduct on bisphenol A, the terephthalic acid, the isophthalic acid, the maleic acid and the trimellitic acid were changed to the components and number of parts shown in Table 1.

The Mw values of the obtained polyester resins were as follows.

(A-2): Mw=19,500

(A-3): Mw=20,100

(A-4): Mw=21,000

(A-5): Mw=23,000

(A-6): Mw=19,400

Synthesis of Resin A (R-1)

Resin A (R-1) was synthesized using the following procedure.

Resin A (R-1) was synthesized in the manner described below by amidation of a carboxyl group in the polyester resin (A-2) and an amino group in the aminosilane.

100.0 parts of the polyester resin (A-2) was dissolved in 400.0 parts of N,N-dimethylacetamide, and the materials below were added thereto and stirred for 5 hours at normal temperature. Following completion of the reaction, resin A (R-1) was obtained by adding this solution dropwise to methanol, reprecipitating and filtering.

Silane compound: 3-aminopropyltrimethoxysilane: 1.2 parts

Condensing agent: DMT-MM (4-(4,4-dimethoxy-1,3,5-triazin-2-yl)-4-methylmorpholinium chloride): 2.4 parts The obtained resin A (R-1) had a silicon concentration of 0.20 mass % and a Mw value of 19,700.

Synthesis of Resin A (R-2) to (R-11) and (R-14)

Resin A (R-2) to (R-11) and (R-14) were obtained in the same way as in the synthesis of resin A (R-1), except that the polyester resin, the silane compound and the condensing agent were changed to the components and number of parts shown in Table 2. Physical properties are shown in Table 2.

Synthesis of Resin A (R-12)

Resin A (R-12) was synthesized using the following procedure.

Resin A (R-12) was synthesized in the manner described below by reacting a hydroxyl group in the polyester resin (A-2) with an isocyanate group in the isocyanatosilane so as to form a urethane bond.

100.0 parts of the polyester resin (A-2) was dissolved in 1,000.0 parts of chloroform, and the materials below were added thereto and stirred for 5 hours at normal temperature in a nitrogen atmosphere. Following completion of the reaction, resin A (R-12) was obtained by adding this solution dropwise to methanol, reprecipitating and filtering.

3-isocyanatopropyldimethylmethoxysilane: 1.2 parts

Titanium (IV) tetraisopropoxide: 1.0 parts

Physical properties of the obtained (R-12) are shown in Table 2.

Synthesis of Resin A (R-13)

Resin A (R-13) was synthesized using the following procedure.

Silane-modified polyester resin A (R-13) was synthesized in the manner described below by forming a linking group represented by formula (14) or formula (15) below by means of a reaction for inserting an epoxy group in the epoxysilane into an ester bond in the polyester resin (A-2).

100.0 parts of the polyester resin (A-2) was dissolved in 200.0 parts of anisole, and the materials below were added thereto and stirred for 5 hours at approximately 140° C. in a nitrogen atmosphere. After being allowed to cool, the reaction mixture was dissolved in 200 mL of chloroform, added dropwise to methanol, reprecipitated and filtered, thereby obtaining resin A (R-13).

Silane compound: 5,6-epoxyhexyltrimethoxysilane: 1.3 parts

Catalyst: tetrabutylphosphonium bromide: 10.0 parts

Physical properties of the obtained (R-13) are shown in Table 2.

(14)

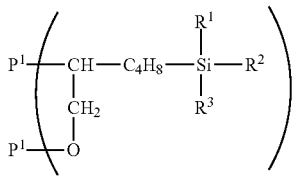

(15)

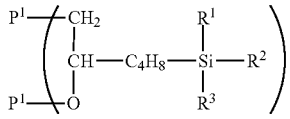

Synthesis of Resin A (R-15)

Resin A (R-15) was synthesized using the following procedure.

Silane-modified polyester resin A (R-15) was synthesized in the manner described below by introducing a silane into a double bond in the polyester resin (A-6) by means of a vinyl polymerization reaction.

100.0 parts of the polyester resin (A-6) was dissolved in 1,000.0 parts of toluene, 1.5 parts of 3-methacryloxypropyldimethylmethoxysilane and 0.6 parts of tert-butylperoxybenzoate [produced by NOF Corp., product name: Perbutyl Z] were added thereto in a nitrogen atmosphere, and a reaction was carried out for 5 hours at 100° C. Resin A (R-15) was obtained by reprecipitating the obtained solution in methanol, filtering, washing and vacuum drying. The obtained (R-15) had a silicon concentration of 0.20 mass % and a Mw value of 19,600.

Preparation of Silica Fine Particles 1

687.9 g of methanol, 42.0 g of pure water and 42.0 g of 28 mass % aqueous ammonia were placed in a 3-liter glass reactor equipped with a stirrer, a dropping funnel and a thermometer, and mixed. The obtained solution was adjusted to a temperature of 35° C., and simultaneous addition of 1,100.0 g (7.23 mol) of tetramethoxysilane and 395.2 g of 5.4 mass % aqueous ammonia was started while stirring. The tetramethoxysilane was added dropwise over a period of 5.0 hours, and the aqueous ammonia was added dropwise over a period of 4 hours.

Following completion of the dropwise addition, a methanol-water dispersed solution of hydrophilic spherical sol-gel silica fine particles was obtained by carrying out hydrolysis by continuing to stir for 0.2 hours.

Next, an ester adapter and a condenser tube were attached to the glass reactor, and methanol was distilled off by heating the dispersed solution to 65° C. Pure water was then added at an amount equivalent to the amount of methanol distilled off. This dispersed solution was dried under reduced pressure at 80° C. The obtained silica fine particles were heated for 10 minutes in a constant temperature bath at 400° C. The obtained silica fine particles (untreated silica) were crushed using a pulverizer (produced by Hosokawa Micron Corp.).

50 g of the silica fine particles were charged in a polytetrafluoroethylene inner cylinder type stainless steel autoclave having an internal capacity of 1,000 mL. After purging the interior of the autoclave with nitrogen gas, 0.5 g of hexamethyldisilazane and 0.1 g of water were uniformly sprayed in the form of a mist onto the silica fine particles while rotating a stirring blade attached to the autoclave at 400 rpm. After stirring for 30 minutes, the autoclave was tightly sealed and heated for 2 hours at 200° C. Silica fine particles 1 were then obtained by removing ammonia through depressurization of the system while continuing the heating. The obtained silica fine particle 1 had a number average primary particle diameter of 100 nm, a SF-1 value of 110 and a SF-2 value of 115. Physical properties are shown in Table 3.

Preparation of Silica Fine Particles 2 to 8

Silica fine particles 2 to 8 were obtained in the same way as in the preparation of silica fine particle 1, except that the amount of 28 mass % aqueous ammonia was changed to the amount shown in Table 3 and the dropwise addition time of tetramethoxysilane and the stirring duration time following completion of dropwise addition were changed to the conditions shown in Table 3. Physical properties are shown in Table 3.

Preparation of Organosilicon Polymer Fine Particle 1

Organosilicon polymer fine particle 1 were prepared using the following procedure.

First Step 360 parts of water was placed in a reaction vessel equipped with a thermometer and stirrer, and 17 parts of hydrochloric acid having a concentration of 5.0 mass % was added thereto to form a uniform solution. While stirring this uniform solution at a temperature of 25° C., 136 parts of methyltrimethoxysilane was added thereto and stirred for 5 hours, after which the solution was filtered to obtain a transparent reaction solution containing a silanol compound or a partial condensate thereof Second Step 540 parts of water was placed in a reaction vessel equipped with a thermometer and stirrer, and dropwise addition apparatus, and 19 parts of aqueous ammonia having a concentration of 10.0 mass % was added to provide a uniform solution. While stirring this at a temperature of 30° C., 100 parts of the reaction solution obtained in the first step was added dropwise over 0.60 hour, and stirring was performed for 6 hours to obtain a suspension. The resulting suspension was processed with a centrifugal separator and the fine particles were sedimented and withdrawn and were dried for 24 hours with a dryer at a temperature of 180° C. to obtain organosilicon polymer fine particle 1.

When $^{29}$Si-NMR measurements were carried out, the ratio of the area of a peak derived from silicon having the T3 unit structure relative to the total area of peaks derived from all silicon element contained in the organosilicon polymer fine particles (the T3 unit structure peak area ratio) was 1.00. In addition, the number average primary particle diameter was 90 nm, the SF-1 value was 106, and the SF-2 value was 110. Physical properties are shown in Table 4.

Preparation of Organosilicon Polymer Fine Particles 2 to 13

Organosilicon polymer fine particles 2 to 13 were obtained in the same way as in the preparation of organosilicon polymer fine particles 1, except that the methyltrimethoxysilane was changed to the alkoxysilane components and number of parts shown in Table 4, and production conditions were changed to those shown in Table 4. Physical properties are shown in Table 4.

TABLE 1

| Resin A | | | | | |
|---|---|---|---|---|---|
| | PO 2.0 mol adduct on bisphenol A | Terephthalic acid | Isophthalic acid | Maleic acid | Trimellitic acid |
| A-1 | 77.4 parts by mass | 15.8 parts by mass | 15.8 parts by mass | — | 0.1 parts by mass |
| A-2 | 77.4 parts by mass | 15.8 parts by mass | 15.8 parts by mass | — | 1.0 parts by mass |
| A-3 | 77.1 parts by mass | 15.0 parts by mass | 15.0 parts by mass | — | 3.0 parts by mass |
| A-4 | 76.5 parts by mass | 13.3 parts by mass | 13.3 parts by mass | — | 6.9 parts by mass |
| A-5 | 75.1 parts by mass | 10.0 parts by mass | 9.2 parts by mass | — | 15.5 parts by mass |
| A-6 | 77.8 parts by mass | 15.1 parts by mass | 15.1 parts by mass | 1.1 parts by mass | 1.0 parts by mass |

*PO: propylene oxide

TABLE 2

| Resin A | | | | | | | | | | | | |
|---|---|---|---|---|---|---|---|---|---|---|---|---|
| | | | | Condensing agent DMT-MM (parts) | Physical properties of resin A | | | | | | | |
| | Polyester resin No. | Silane compound | Number of parts | | $R^1$ | $R^2$ | $R^3$ | $L^1$ | $R^5$ | Silicon concentration | Mw |
| R-1 | A-2 | 3-aminopropyltrimethoxysilane | 1.2 | 2.4 | —OMe | —OMe | —OMe | Formula(3) | —C3H6— | 0.20% | 19700 |
| R-2 | A-2 | 3-aminopropyltrimethoxysilane | 0.1 | 0.2 | —OMe | —OMe | —OMe | Formula(3) | —C3H6— | 0.02% | 19500 |
| R-3 | A-2 | 3-aminopropyltrimethoxysilane | 0.6 | 1.2 | —OMe | —OMe | —OMe | Formula(3) | —C3H6— | 0.10% | 19600 |
| R-4 | A-2 | 3-aminopropyltrimethoxysilane | 0.9 | 1.8 | —OMe | —OMe | —OMe | Formula(3) | —C3H6— | 0.15% | 19600 |
| R-5 | A-3 | 3-aminopropyltrimethoxysilane | 3.1 | 6.2 | —OMe | —OMe | —OMe | Formula(3) | —C3H6— | 0.50% | 20200 |
| R-6 | A-4 | 3-aminopropyltrimethoxysilane | 6.3 | 12.7 | —OMe | —OMe | —OMe | Formula(3) | —C3H6— | 0.99% | 21100 |

TABLE 2-continued

| Resin A | | | | | | | | | | | |
|---|---|---|---|---|---|---|---|---|---|---|---|
| | | | | Condensing | Physical properties of resin A | | | | | | |
| | Polyester resin No. | Silane compound | Number of parts | agent DMT-MM (parts) | $R^1$ | $R^2$ | $R^3$ | $L^1$ | $R^5$ | Silicon concentration | Mw |
| R-7 | A-5 | 3-aminopropyltrimethoxysilane | 13.8 | 27.7 | —OMe | —OMe | —OMe | Formula(3) | —C3H6— | 2.00% | 23200 |
| R-8 | A-2 | 3-aminophenyltrimethoxysilane | 1.4 | 2.5 | —OMe | —OMe | —OMe | Formula(3) | —Ph— | 0.20% | 19800 |
| R-9 | A-2 | 3-aminopropyltriethoxysilane | 1.5 | 2.5 | —OEt | —OEt | —OEt | Formula(3) | —C3H6— | 0.20% | 19800 |
| R-10 | A-2 | 3-aminopropylmethyldimethoxysilane | 1.1 | 2.4 | —OMe | —OMe | —Me | Formula(3) | —C3H6— | 0.20% | 19700 |
| R-11 | A-2 | 3-aminopropyldimethylmethoxysilane | 1.0 | 2.3 | —OMe | —Me | —Me | Formula(3) | —C3H6— | 0.20% | 19700 |
| R-12 | A-2 | 3-isocyanatopropyldimethylmethoxysilane | 1.2 | — | —OMe | —Me | —Me | Formula(3) | —C3H6— | 0.20% | 19700 |
| R-13 | A-2 | 5,6-epoxyhexyltrimethoxysilane | 1.3 | — | —OMe | —OMe | —OMe | Formula(14) or Formula(15) | —C4H8— | 0.20% | 19800 |
| R-14 | A-2 | 11-aminoundecyldimethylmethoxysilane | 1.7 | 2.5 | —OMe | —Me | —Me | Formula(3) | —C11H22— | 0.20% | 19800 |

In the tables, —OMe denotes a methoxy group, —Me denotes a methyl group, —OEt denotes an ethoxy group, and -Ph- denotes a phenylene group. The silicon concentration indicates the content (mass %) of silicon atoms in the resin A.

TABLE 3

| Silica particle formulations | | | | | | |
|---|---|---|---|---|---|---|
| Silica | Production process | | | | | |
| fine particle No. | 28 mass % aqueous ammonia | Dropwise addition time | Stirring duration time | Physical properties Particle diameter | SF-1 | SF-2 |
| 1 | 42.0 g | 5.0 hours | 0.2 hours | 100 nm | 110 | 115 |
| 2 | 30.0 g | 5.0 hours | 0.2 hours | 30 nm | 109 | 114 |

TABLE 3-continued

| Silica particle formulations | | | | | | |
|---|---|---|---|---|---|---|
| Silica | Production process | | | | | |
| fine particle No. | 28 mass % aqueous ammonia | Dropwise addition time | Stirring duration time | Physical properties Particle diameter | SF-1 | SF-2 |
| 3 | 36.0 g | 4.5 hours | 0.0 hours | 50 nm | 120 | 130 |
| 4 | 80.0 g | 5.0 hours | 0.2 hours | 200 nm | 107 | 110 |
| 5 | 115.0 g | 5.0 hours | 0.2 hours | 300 nm | 112 | 117 |
| 6 | 40.0 g | 5.0 hours | 0.2 hours | 90 nm | 105 | 101 |
| 7 | 40.0 g | 5.0 hours | 0.0 hours | 90 nm | 108 | 130 |
| 8 | 40.0 g | 4.5 hours | 0.2 hours | 90 nm | 120 | 104 |

In the table, the particle diameter indicates the number average primary particle diameter.

TABLE 4

| Organosilicon polymer fine particle formulations | | | | | | | | | | |
|---|---|---|---|---|---|---|---|---|---|---|
| | First step | | | | | | | | | |
| | Alkoxysilane* | | | | | | | | | |
| Organosilicon polymer fine particle No. | Methyltrimethoxysilane | Dimethyldimethoxysilane | Trimethylmethoxysilane | Ethyltrimethoxysilane | n-propyltrimethoxysilane | Hexyltrimethoxysilane | Phenyltrimethoxysilane | Water* | Hydrochloric acid* | Reaction temperature |
| 1 | 136.0 | — | — | — | — | — | — | 360 | 17 | 25° C. |
| 2 | 136.0 | — | — | — | — | — | — | 360 | 17 | 25° C. |
| 3 | 136.0 | — | — | — | — | — | — | 360 | 17 | 25° C. |
| 4 | 136.0 | — | — | — | — | — | — | 360 | 17 | 25° C. |
| 5 | 136.0 | — | — | — | — | — | — | 360 | 17 | 25° C. |
| 6 | 136.0 | — | — | — | — | — | — | 360 | 17 | 25° C. |
| 7 | — | — | — | — | 39.3 | 49.3 | 47.4 | 360 | 17 | 25° C. |
| 8 | — | — | — | 136.0 | — | — | — | 360 | 17 | 25° C. |
| 9 | — | 11.1 | — | 124.9 | — | — | — | 360 | 17 | 25° C. |
| 10 | 98.7 | 37.3 | — | — | — | — | — | 360 | 17 | 25° C. |
| 11 | 92.2 | 43.8 | — | — | — | — | — | 360 | 17 | 25° C. |
| 12 | 136.0 | — | — | — | — | — | — | 360 | 17 | 25° C. |
| 13 | 136.0 | — | — | — | — | — | — | 360 | 17 | 25° C. |

TABLE 4-continued

| Organosilicon polymer fine particle formulations | | | | | | | | | |
|---|---|---|---|---|---|---|---|---|---|
| | Second step | | | | | Physical properties | | | |
| Organosilicon polymer fine particle No. | Reaction liquid obtained in first step* | Water* | Aqueous ammonia* | Reaction temperature | Dropwise addition time | Areal ratio of peaked derived from T3 unit | Number average particle diameter | SF-1 | SF-2 |
| 1 | 100 | 540 | 19 | 30° C. | 0.60 hours | 1.00 | 90 nm | 106 | 110 |
| 2 | 100 | 540 | 13 | 30° C. | 2.00 hours | 1.00 | 30 nm | 108 | 112 |
| 3 | 100 | 540 | 17 | 30° C. | 1.00 hours | 1.00 | 50 nm | 120 | 129 |
| 4 | 100 | 540 | 23 | 30° C. | 0.40 hours | 1.00 | 200 nm | 109 | 114 |
| 5 | 100 | 540 | 28 | 30° C. | 0.20 hours | 1.00 | 300 nm | 110 | 111 |
| 6 | 100 | 540 | 19 | 28° C. | 0.60 hours | 1.00 | 90 nm | 106 | 103 |
| 7 | 100 | 540 | 19 | 30° C. | 0.60 hours | 1.00 | 90 nm | 106 | 130 |
| 8 | 100 | 540 | 19 | 30° C. | 0.60 hours | 1.00 | 90 nm | 120 | 105 |
| 9 | 100 | 540 | 19 | 30° C. | 0.60 hours | 0.90 | 90 nm | 108 | 105 |
| 10 | 100 | 540 | 19 | 30° C. | 0.60 hours | 0.70 | 90 nm | 110 | 109 |
| 11 | 100 | 540 | 19 | 30° C. | 0.60 hours | 0.65 | 90 nm | 109 | 113 |
| 12 | 100 | 540 | 20 | 40° C. | 0.50 hours | 1.00 | 90 nm | 150 | 130 |
| 13 | 100 | 540 | 18 | 20° C. | 0.50 hours | 1.00 | 90 nm | 160 | 170 |

*Numerical values for the alkoxysilane, the water, the hydrochloric acid, the reaction liquid obtained in the first step and the aqueous ammonia indicate number of parts thereof added.

Production of Toner Particle 1

Production of Aqueous Medium 1

390.0 parts of deionized water and 14.0 parts of sodium phosphate (dodecahydrate) (RASA Industries, Ltd.) were introduced into a reactor and the temperature was held at 65° C. for 1.0 hour while purging with nitrogen.

An aqueous calcium chloride solution of 9.2 parts calcium chloride (dihydrate) dissolved in 10.0 parts of deionized water was introduced all at once while stirring at 12,000 rpm using a T. K. Homomixer (Tokushu Kika Kogyo Co., Ltd.) to prepare an aqueous medium containing a dispersion stabilizer.

10% hydrochloric acid was introduced into this aqueous medium to adjust the pH to 6.0 and provide aqueous medium 1.

Polymerizable Monomer Composition 1 Production styrene: 60 parts colorant (C.I. Pigment Blue 15:3): 6.5 parts A dispersed solution 1 in which the colorant was dispersed was prepared by introducing the materials listed above into an attritor (produced by Nippon Coke and Engineering Co., Ltd.) and then dispersing for 5.0 hours at 220 rpm using zirconia particles having diameters of 1.7 mm.

The following materials were added to this dispersion 1.

| | |
|---|---|
| styrene | 20.0 parts |
| n-butyl acrylate | 20.0 parts |
| resin A (R-1) | 1.0 parts |
| polyester resin (A-1) | 7.0 parts |
| Fischer-Tropsch wax (melting point: 78° C.) | 7.0 parts |
| behenyl behenate wax (melting point: 74° C.) | 3.0 parts |

This was then held at 65° C. and a polymerizable monomer composition 1 was prepared by dissolving and dispersing to uniformity at 500 rpm using a T. K. Homomixer.

Granulation Step

While holding the temperature of aqueous medium 1 at 70° C. and the stirrer rotation rate at 12,000 rpm, the polymerizable monomer composition 1 was introduced into the aqueous medium 1 and 9.0 parts of the polymerization initiator t-butyl peroxypivalate was added. Granulation was performed for 10 minutes while maintaining 12,000 rpm with the stirrer.

Polymerization Step

The high-speed stirrer was replaced with a stirrer equipped with a propeller impeller and polymerization was carried out for 5.0 hours while maintaining 70° C. and stirring at 150 rpm. An additional polymerization reaction was run by raising the temperature to 85° C. and heating for 2.0 hours to obtain toner particle dispersion 1.

Washing and Filtration Step

The pH was then adjusted to 1.5 with 1 mol/L hydrochloric acid; stirring was subsequently carried out for 1 hour; and filtration was performed while washing with deionized water to obtain toner particle 1.

Production of Toner Particle 2

Toner particle 2 was produced in the same way as toner particle 1, except that the resin A (R-1) and the polyester resin (A-1) were changed as shown below.

| | |
|---|---|
| resin A (R-1) | 0.1 parts |
| polyester resin (A-1) | 7.9 parts |

Production of Toner Particle 3

Toner particle 3 was produced in the same way as toner particle 1, except that the resin A (R-1) and the polyester resin (A-1) were changed as shown below.

| | |
|---|---|
| resin A (R-1) | 3.0 parts |
| polyester resin (A-1) | 5.0 parts |

Production of Toner Particle 4

Toner particle 4 was produced in the same way as toner particle 1, except that the resin A (R-1) and the polyester resin (A-1) were changed as shown below.

| | |
|---|---|
| resin A (R-1) | 7.0 parts |
| polyester resin (A-1) | 1.0 parts |

Production of Toner Particle 5

Toner particle 5 was produced in the same way as toner particle 1, except that the resin A (R-1) and the polyester resin (A-1) were changed as shown below.

| | |
|---|---|
| resin A (R-1) | 10.0 parts |
| polyester resin (A-1) | 1.0 parts |

Production of Toner Particles 6 to 11, 24 and 25

Toner particles 6 to 11, 24 and 25 were produced in the same way as toner particle 1, except that the resin A (R-1) was changed to resin A (R-2) to (R-7), (R-13) and (R-14).

Production of Toner Particle 12

Toner particle 12 was produced in the same way as toner particle 1, except that the amount of behenyl behenate wax was changed to 0 parts.

Production of Toner Particles 16 to 20

Toner particles 16 to 20 were produced in the same way as toner particle 1, except that the amount of behenyl behenate wax was changed to 0 parts and the resin A (R-1) was changed to resin A (R-8) to (R-12).

Production of Toner particle 13 Production of Resin Particle Dispersion 1

The following materials were weighed out and mixed and dissolved.

| | |
|---|---|
| styrene | 82.6 parts |
| n-butyl acrylate | 9.2 parts |
| acrylic acid | 1.3 parts |
| resin A (R-1) | 3.0 parts |
| hexanediol diacrylate | 0.4 parts |
| n-lauryl mercaptan | 3.2 parts |

A 10% aqueous solution of Neogen RK (DKS Co., Ltd.) was added to the resulting solution and dispersion was carried out. An aqueous solution of 0.15 parts of potassium persulfate dissolved in 10.0 parts of deionized water was added while gently stirring for 10 minutes. After substitution with nitrogen, an emulsion polymerization was run for 6.0 hours at a temperature of 70° C.

After completion of the polymerization, the reaction solution was cooled to room temperature and deionized water was added to yield a resin particle dispersion having a solids concentration of 12.5% and a median diameter on a volume basis of 0.2 μm.

Production of Resin Particle Dispersion 2

Resin particle dispersion 2 was obtained in the same way as resin particle dispersion 1, except that the resin A (R-1) was not added.

(Production of wax particle dispersion)

The following materials were weighed out and mixed.

| | |
|---|---|
| Fischer Tropsch wax (melting point: 78° C.) | 100.0 parts |
| Neogen RK (DKS Co., Ltd.) | 15.0 parts |
| deionized water | 385.0 parts |

These materials were dispersed for 1 hour using a JN100 wet jet mill (Jokoh Co., Ltd.) to yield a wax particle dispersion. The wax solids concentration in this wax particle dispersion was 20.0%.

Colorant Particle Dispersion Production

The following materials were weighed out and mixed.

| | |
|---|---|
| colorant (C. I. Pigment Blue 15:3) | 100.0 parts |
| Neogen RK (DKS Co., Ltd.) | 15.0 parts |
| deionized water | 885.0 parts |

These materials were dispersed for 1 hour using a JN100 wet jet mill (Jokoh Co., Ltd.) to yield a colorant particle dispersion.

Formation of Aggregate Particles

| | |
|---|---|
| resin particle dispersion 2 | 140.0 parts |
| wax particle dispersion | 10.0 parts |
| colorant particle dispersion | 10.0 parts |
| magnesium sulfate | 0.2 parts |

These materials were dispersed using a homogenizer (Ultra-Turrax T50, IKA Works GmbH & Co. KG), followed by heating to 65° C. while stirring.

After stirring for 1.0 hours at 65° C., 20.0 parts of resin particle dispersion 1 was added, and stirring was carried out for a further 0.2 hours. Observation with an optical microscope confirmed the formation of aggregated particles having a number average particle diameter of 7.0 μm.

To this was then added 2.2 parts of Neogen RK (DKS Co., Ltd.), followed by heating to 80° C. and stirring for 2.0 hours to obtain fused spherical toner particles.

Cooling was carried out followed by filtration, and the separated solid was washed for 1.0 hour by stirring with 720.0 parts of deionized water. The toner particle-containing solution was filtered, and toner particle 13 was obtained by drying using a vacuum dryer.

Production of Toner Particle 14

Those parts of the process for producing toner particle 13 from aggregate particle formation onwards were changed as shown below.

| | |
|---|---|
| resin particle dispersion 1 | 160.0 parts |
| wax particle dispersion | 10.0 parts |
| colorant particle dispersion | 10.0 parts |
| magnesium sulfate | 0.2 parts |

The materials listed above were dispersed using a homogenizer (an Ultratarax T50 produced by IKA) and then heated to 65° C. while stirring.

When observed with an optical microscope after stirring for 1.2 hours at 65° C., it was confirmed that aggregate particles having a number average particle diameter of 7.0 μm were formed.

After adding 2.2 parts of Neogen RK (produced by Dai-ichi Kogyo Seiyaku Co., Ltd.) to this, fused spherical toner particles were obtained by heating to 80° C. and stirring for 2.0 hours.

A solid obtained by cooling, filtering and filtering off was stirred and washed with water for 1.0 hours using 720.0 parts of ion exchanged water. Toner particle 14 was obtained by filtering the toner particle-containing solution and drying using a vacuum dryer.

Production of Toner Particle 15

The following materials were introduced into a reactor fitted with a condenser tube, stirrer, and nitrogen introduction tube.

| | |
|---|---|
| terephthalic acid | 29.0 parts |
| polyoxypropylene(2.2)-2,2-bis(4-hydroxyphenyl)propane | 80.0 parts |
| titanium dihydroxybis(triethanolaminate) | 0.1 parts |

This was followed by heating to 200° C. and reaction for 9 hours while introducing nitrogen and removing the evolved water. Polyester resin (A-7) was synthesized as a binder resin by adding 5.8 parts of trimellitic anhydride, heating to 170° C. and reacting for 3 hours.

| | |
|---|---|
| low-density polyethylene (melting point: 100° C.) | 20.0 parts |
| styrene | 64.0 parts |
| n-butyl acrylate | 13.5 parts |
| acrylonitrile | 2.5 parts |

In addition, the materials listed above were charged in an autoclave, the system was purged with nitrogen, and a temperature of 180° C. was maintained while stirring. 50.0 parts of a 2.0% xylene solution of t-butyl hydroperoxide was continuously added dropwise over 4.5 hours to the system, and, after cooling, the solvent was separated and removed to yield a graft polymer in which a copolymer was grafted on polyethylene.

| | |
|---|---|
| polyester resin (A-7) | 100.0 parts |
| resin A (R-1) | 3.0 parts |
| Fischer Tropsch wax (melting point: 78° C.) | 5.0 parts |
| graft polymer | 5.0 parts |
| C. I. Pigment Blue 15:3 | 5.0 parts |

These materials were thoroughly mixed using an FM mixer (Model FM-75, Nippon Coke & Engineering Co., Ltd.) followed by melt-kneading with a twin-screw kneader (Model PCM-30, Ikegai Ironworks Corporation) set to a temperature of 100° C.

The resulting kneaded material was cooled and was coarsely pulverized to 1 mm and below using a hammer mill to yield a coarse pulverizate. Then, a finely pulverized material of about 5 μm was obtained from this coarse pulverizate using a Turbo Mill from Turbo Kogyo Co., Ltd. (T-250: RSS rotor/SNB liner).

The fines and coarse powder were subsequently cut using a Coanda effect-based multi-grade classifier to obtain toner particle 15.

Production of Toner Particle 21

Toner particle 21 was produced in the same way as toner particle 1, except that the resin A (R-1) was changed to resin A (R-15).

Production of Toner Particle 22

Toner particle 22 was produced in the same way as toner particle 1, except that the resin A (R-1) was changed to 0.2 parts of 3-methacryloxypropyldimethylmethoxysilane.

Production of Toner Particle 23

The process for producing the wax particle dispersion in the production of toner particle 13 was changed in the manner shown below.

70.0 parts of a Fischer Tropsch wax (melting point: 78° C.) and 30.0 parts of behenyl behenate (melting point: 74° C.) were used instead of 100.0 parts of a Fischer Tropsch wax (melting point: 78° C.).

In addition, those parts of those process from aggregate particle formation onwards were changed as shown below.

| | |
|---|---|
| resin particle dispersion 2 | 160.0 parts |
| wax particle dispersion | 10.0 parts |
| colorant particle dispersion | 10.0 parts |
| magnesium sulfate | 0.2 parts |

The materials listed above were dispersed using a homogenizer (an Ultratarax T50 produced by IKA) and then heated to 65° C. while stirring.

When observed with an optical microscope after stirring for 1.2 hours at 65° C., it was confirmed that aggregate particles having a number average particle diameter of 7.0 μm were formed.

After adding 2.2 parts of Neogen RK (produced by Dai-ichi Kogyo Seiyaku Co., Ltd.) to this, fused spherical toner particles were obtained by heating to 80° C. and stirring for 2.0 hours.

A solid obtained by cooling, filtering and filtering off was stirred and washed with water for 1.0 hours using 720.0 parts of ion exchanged water. Toner particle 23 was obtained by filtering the toner particle-containing solution and drying using a vacuum dryer.

When toner particles obtained using the methods described above were evaluated using TOF-SIMS, it was confirmed that Si-containing resin A was present in a surface layer in toner particles 1 to 22, 24 and 25.

Production of Toner 1

Toner 1 was obtained by mixing 100 parts of toner particle 1, 1.0 parts of silica fine particle 1 and 1.0 parts of organosilicon polymer fine particles 1 for 5 minutes in a Henschel mixer (produced by Mitsui Miike Kakoki Corporation). The temperature of the Henschel mixer jacket was set to 10° C., and the peripheral speed of a rotating blade was 38 m/sec.

Production of Toners 2 to 44 and Comparative Toners 1 to 6

These were produced in the same way as in the production of toner 1, except that toner particle 1 was replaced with toner particles 2 to 25, silica fine particle 1 were replaced with silica fine particles 2 to 8, and organosilicon polymer fine particles 1 were replaced with organosilicon polymer fine particles 2 to 13, as shown in Table 5. The number of parts of external additive was changed as shown in Table 5. R-972 produced by Nippon Aerosil Co. Ltd. (number average primary particle diameter: 18 nm, SF-1: 150, SF-2: 160) was used as the fumed silica used in comparative toner 1. Other than these changes, toners 2 to 44 and comparative toners 1 to 6 were obtained in the same way as in the production of toner 1.

Evaluation of Initial Image Streaks and Image Streaks Following Long Term Use

Image streaks are vertical streaks measuring approximately 0.5 mm, and are produced by detachment of organosilicon polymer fine particles, and these are image defects that are easily observed when an entire surface halftone image is outputted.

A modified LBP712Ci (produced by Canon Inc.) was used as an image forming apparatus. The processing speed of this apparatus was modified to 250 mm/sec. In addition, essential adjustments were carried out so that image formation was possible under these conditions. In addition, toners were removed from the black and cyan cartridges and replaced with 50 g each of a toner being evaluated. The toner laid-on level was 1.0 mg/cm$^2$.

Image streaks were evaluated during continuous use in a normal temperature normal humidity environment (23° C., 60% RH). XEROX 4200 paper (produced by XEROX, 75 g/m$^2$) was used as an evaluation paper.

In a normal temperature normal humidity environment, 1,000 sheets of intermittent continuous use was performed, outputting two sheets of E-shaped images every 4 seconds at a image coverage of 1%, after which a 50% halftone image was outputted on an entire sheet, and the presence or absence of streaks was observed. Evaluation results at this point were taken to be initial image streaks (initial streaks).

In addition, after intermittently printing another 14,000 sheets, a 50% halftone image was outputted on an entire sheet, and the presence or absence of streaks was observed. Evaluation results at this point were taken to be image streaks following long term use (streaks following long term use).

A to C were assessed as being good. The evaluation results are shown in Table 6.

Evaluation Criteria

A: No streaks or toner lumps.

B: No spot-like streaks but 1 to 2 small toner lumps.

C: 1 to 2 spot-like streaks at edge parts or 3 to 4 small toner lumps.

D: 1 to 2 spot-like streaks over the entire surface or 5 to 6 small toner lumps.

E: 3 or more spot-like streaks over the entire surface or 7 or more small toner lumps.

Evaluation of Fogging Following Long Term Use

Fogging following continuous use in a normal temperature normal humidity environment (23° C., 60% RH) was evaluated using the same image forming apparatus as that used for evaluating image streaks. XEROX 4200 paper (produced by XEROX, 75 g/m$^2$) was used as a paper for long term use.

In a normal temperature normal humidity environment, intermittent continuous use of 15,000 was performed, outputting two sheets of E-shaped images every 4 seconds at a image coverage of 1%.

Next, a solid white image having an image coverage rate of 0% was printed out using a letter sized HP Brochure Paper 200 g, Glossy (basis weight 200 g/cm$^2$) as an evaluation paper in gloss paper mode (⅓ speed). Using a REFLECTMETER MODEL TC-6DS (produced by Tokyo Denshoku Co., Ltd.), the fogging concentration (%) was calculated from the difference between the measured whiteness of a white background part of the printed out image and the whiteness of a transfer paper, and image fogging (fogging after long term use) was evaluated. An amber filter was used as a filter.

A lower value indicates a more favorable evaluation. Evaluation criteria are as follows.

A to C were assessed as being good. The evaluation results are shown in Table 6.

Evaluation Criteria

A: Less than 1.0%

B: At least 1.0% but less than 2.0%

C: At least 2.0% but less than 3.0%

D: At least 3.0%

Evaluation of the Tape Peelability

A color laser printer (HP Color LaserJet 3525dn, Hewlett-Packard Enterprise Development LP) modified to enable adjustment of the developing bias was used as the image-forming apparatus, and FOX RIVER BOND paper (110 g/m$^2$), which has a relatively large surface unevenness and areal weight, was used as the fixing media.

A line image is used for the image in the evaluation. By increasing the amount of toner on the image by establishing a high image density by swinging the developing bias, and by using a heavy paper having a large amount of surface unevenness, melting of the toner in the depressed portions in the paper and in the lower layer region of the toner layer during the fixing step can be made more difficult, thus enabling a rigorous evaluation of peeling.

The evaluation procedure is as follows. The image-forming apparatus was first held overnight in a low-temperature, low-humidity environment (15° C., 10% RH). When a low temperature is used for the evaluation environment, it is then more difficult for the fixing unit to warm up and a rigorous evaluation can be carried out.

Using the FOX RIVER BOND paper, a horizontal line image is then printed with the developing bias adjusted to give a line width of 180 μm. After standing for 1 hour in the low-temperature, low-humidity environment, a polypropylene tape (Klebeband 19 mm×10 mm, from tesa SE) was applied to the horizontal line image and was gradually peeled off. After peeling, the image was visually and microscopically inspected and was evaluated in accordance with the following evaluation criteria. A to C were assessed as being good. The evaluation results are shown in Table 6.

Evaluation Criteria

A: no loss

B: slight loss is observed, but is not recognized by visual inspection

C: loss that can also be recognized visually is observed to a slight degree

D: there is loss that can be recognized visually and locations occur where a line has been cut Evaluation of Fixing Wraparound The same image forming apparatus as that used for evaluating image streaks was modified so as to enable the fixing temperature to be adjusted. GF-600 (produced by Canon Marketing Japan K.K., 60 g/m$^2$) was used as an evaluation paper. An outputted image was a whole page solid image, and was evaluated in a normal temperature normal humidity environment (23° C., 60% RH).

Fixing temperature was altered in 5° C. increments from 140° C. An evaluation toner was fixed, and the state of paper feed at this point was confirmed visually. Fixing wraparound was evaluated on the basis of the following criteria from the temperature of a fixing unit at which paper could feed without wrapping around.

A to C were assessed as being good. The evaluation results are shown in Table 6.

Evaluation Criteria

A: Lower than 150° C.

B: At least 150° C. but lower than 155° C.

C: At least 155° C. but lower than 160° C.

D: At least 160° C.

TABLE 5

| | Toner particle No. | Si count | Silica fine particle No. | Number of parts | Organosilicon polymer fine particle No. | Number of parts | Others | Number of parts |
|---|---|---|---|---|---|---|---|---|
| Toner 1 | 1 | 0.0019 | 1 | 1.0 | 1 | 1.0 | — | — |
| Toner 2 | 2 | 0.0010 | 1 | 1.0 | 1 | 1.0 | — | — |
| Toner 3 | 3 | 0.0031 | 1 | 1.0 | 1 | 1.0 | — | — |
| Toner 4 | 4 | 0.0039 | 1 | 1.0 | 1 | 1.0 | — | — |
| Toner 5 | 5 | 0.0050 | 1 | 1.0 | 1 | 1.0 | — | — |
| Toner 6 | 6 | 0.0011 | 1 | 1.0 | 1 | 1.0 | — | — |
| Toner 7 | 7 | 0.0016 | 1 | 1.0 | 1 | 1.0 | — | — |
| Toner 8 | 8 | 0.0018 | 1 | 1.0 | 1 | 1.0 | — | — |
| Toner 9 | 9 | 0.0033 | 1 | 1.0 | 1 | 1.0 | — | — |
| Toner 10 | 10 | 0.0041 | 1 | 1.0 | 1 | 1.0 | — | — |
| Toner 11 | 11 | 0.0049 | 1 | 1.0 | 1 | 1.0 | — | — |
| Toner 12 | 1 | 0.0019 | 2 | 1.0 | — | — | — | — |
| Toner 13 | 1 | 0.0019 | 3 | 1.0 | — | — | — | — |

TABLE 5-continued

| | Toner particle No. | Si count | Silica fine particle No. | Number of parts | Organosilicon polymer fine particle No. | Number of parts | Others | Number of parts |
|---|---|---|---|---|---|---|---|---|
| Toner 14 | 1 | 0.0019 | 1 | 1.0 | — | — | — | — |
| Toner 15 | 1 | 0.0019 | 4 | 1.0 | — | — | — | — |
| Toner 16 | 1 | 0.0019 | 5 | 1.0 | — | — | — | — |
| Toner 17 | 1 | 0.0019 | 6 | 0.1 | — | — | — | — |
| Toner 18 | 1 | 0.0019 | 7 | 0.5 | — | — | — | — |
| Toner 19 | 1 | 0.0019 | 8 | 2.0 | — | — | — | — |
| Toner 20 | 1 | 0.0019 | 1 | 6.0 | — | — | — | — |
| Toner 21 | 1 | 0.0019 | — | — | 2 | 1.0 | — | — |
| Toner 22 | 1 | 0.0019 | — | — | 3 | 1.0 | — | — |
| Toner 23 | 1 | 0.0019 | — | — | 1 | 1.0 | — | — |
| Toner 24 | 1 | 0.0019 | — | — | 4 | 1.0 | — | — |
| Toner 25 | 1 | 0.0019 | — | — | 5 | 1.0 | — | — |
| Toner 26 | 1 | 0.0019 | — | — | 6 | 0.1 | — | — |
| Toner 27 | 1 | 0.0019 | — | — | 7 | 0.5 | — | — |
| Toner 28 | 1 | 0.0019 | — | — | 8 | 2.0 | — | — |
| Toner 29 | 1 | 0.0019 | — | — | 1 | 6.0 | — | — |
| Toner 30 | 12 | 0.0020 | — | — | 1 | 1.0 | — | — |
| Toner 31 | 13 | 0.0017 | — | — | 1 | 1.0 | — | — |
| Toner 32 | 15 | 0.0012 | — | — | 1 | 1.0 | — | — |
| Toner 33 | 14 | 0.0013 | — | — | 1 | 1.0 | — | — |
| Toner 34 | 12 | 0.0020 | — | — | 9 | 1.0 | — | — |
| Toner 35 | 12 | 0.0020 | — | — | 10 | 1.0 | — | — |
| Toner 36 | 12 | 0.0020 | — | — | 11 | 1.0 | — | — |
| Toner 37 | 16 | 0.0012 | 1 | 1.0 | — | — | — | — |
| Toner 38 | 12 | 0.0020 | 1 | 1.0 | — | — | — | — |
| Toner 39 | 17 | 0.0020 | 1 | 1.0 | — | — | — | — |
| Toner 40 | 18 | 0.0017 | 1 | 1.0 | — | — | — | — |
| Toner 41 | 19 | 0.0017 | 1 | 1.0 | — | — | — | — |
| Toner 42 | 20 | 0.0025 | 1 | 1.0 | — | — | — | — |
| Toner 43 | 21 | 0.0020 | 1 | 1.0 | — | — | — | — |
| Toner 44 | 22 | 0.0022 | 1 | 1.0 | — | — | — | — |
| Comparative toner 1 | 22 | 0.0022 | — | — | — | — | Fumed silica | 1.0 |
| Comparative toner 2 | 22 | 0.0022 | — | — | 12 | 1.0 | — | — |
| Comparative toner 3 | 22 | 0.0022 | — | — | 13 | 1.0 | — | — |
| Comparative toner 4 | 23 | 0.0002 | — | — | 1 | 1.0 | — | — |
| Comparative toner 5 | 24 | 0.0014 | 1 | 1.0 | — | — | — | — |
| Comparative toner 6 | 25 | 0.0011 | — | — | 1 | 1.0 | — | — |

In the table, "Si count" indicates the ion count derived from silicon, which has a mass number of 28, wherein the total ion count for ions having mass numbers of 1 to 1,800 is taken to be 1 in TOF-SIMS measurements of a toner particle surface.

TABLE 6

| Evaluation results | | | | | | | | |
|---|---|---|---|---|---|---|---|---|
| | | | Streaks following | Fogging following long term use | | Tape release | Fixing wraparound | |
| | Evaluation toner | Initial streaks | long term use | Fogging value | Rank | properties Rank | Fixing temperature | Rank |
| Example 1 | Toner 1 | A | A | 0.4% | A | A | 140° C. | A |
| Example 2 | Toner 2 | A | A | 0.5% | A | A | 140° C. | A |
| Example 3 | Toner 3 | A | A | 0.6% | A | A | 140° C. | A |
| Example 4 | Toner 4 | A | A | 0.4% | A | A | 140° C. | A |
| Example 5 | Toner 5 | A | A | 0.6% | A | B | 145° C. | A |
| Example 6 | Toner 6 | A | C | 0.3% | A | A | 140° C. | A |
| Example 7 | Toner 7 | A | B | 0.7% | A | A | 140° C. | A |
| Example 8 | Toner 8 | A | A | 0.6% | A | A | 140° C. | A |
| Example 9 | Toner 9 | A | A | 0.4% | A | A | 140° C. | A |
| Example 10 | Toner 10 | A | A | 0.5% | A | A | 140° C. | A |
| Example 11 | Toner 11 | A | A | 0.4% | A | B | 145° C. | A |
| Example 12 | Toner 12 | A | B | 1.3% | B | A | 140° C. | A |
| Example 13 | Toner 13 | A | A | 1.2% | B | A | 140° C. | A |

TABLE 6-continued

| | Evaluation results | | | | | | | |
|---|---|---|---|---|---|---|---|---|
| | | | Streaks following | Fogging following long term use | | Tape release | Fixing wraparound | |
| | Evaluation toner | Initial streaks | long term use | Fogging value | Rank | properties Rank | Fixing temperature | Rank |
| Example 14 | Toner 14 | A | A | 1.1% | B | A | 140° C. | A |
| Example 15 | Toner 15 | A | A | 1.0% | B | A | 145° C. | A |
| Example 16 | Toner 16 | B | A | 1.0% | B | A | 145° C. | A |
| Example 17 | Toner 17 | A | A | 1.3% | B | A | 140° C. | A |
| Example 18 | Toner 18 | A | A | 1.4% | B | A | 140° C. | A |
| Example 19 | Toner 19 | A | A | 1.3% | B | A | 145° C. | A |
| Example 20 | Toner 20 | A | A | 1.6% | B | B | 145° C. | A |
| Example 21 | Toner 21 | A | B | 1.0% | B | A | 140° C. | A |
| Example 22 | Toner 22 | A | B | 0.9% | A | A | 140° C. | A |
| Example 23 | Toner 23 | A | B | 0.6% | A | A | 140° C. | A |
| Example 24 | Toner 24 | A | B | 0.7% | A | A | 145° C. | A |
| Example 25 | Toner 25 | B | B | 0.8% | A | A | 145° C. | A |
| Example 26 | Toner 26 | A | B | 0.9% | A | A | 140° C. | A |
| Example 27 | Toner 27 | A | B | 0.8% | A | A | 140° C. | A |
| Example 28 | Toner 28 | A | B | 0.8% | A | A | 145° C. | A |
| Example 29 | Toner 29 | A | B | 0.9% | A | B | 145° C. | A |
| Example 30 | Toner 30 | A | B | 0.9% | A | A | 150° C. | B |
| Example 31 | Toner 31 | A | B | 0.6% | A | A | 150° C. | B |
| Example 32 | Toner 32 | B | B | 0.5% | A | A | 150° C. | B |
| Example 33 | Toner 33 | B | B | 0.5% | A | A | 150° C. | B |
| Example 34 | Toner 34 | A | B | 0.6% | A | A | 150° C. | B |
| Example 35 | Toner 35 | A | B | 0.8% | A | A | 150° C. | B |
| Example 36 | Toner 36 | A | B | 0.9% | A | A | 150° C. | B |
| Example 37 | Toner 37 | A | A | 1.0% | B | A | 150° C. | B |
| Example 38 | Toner 38 | A | A | 1.2% | B | A | 150° C. | B |
| Example 39 | Toner 39 | A | A | 1.6% | B | A | 150° C. | B |
| Example 40 | Toner 40 | B | A | 1.7% | B | A | 150° C. | B |
| Example 41 | Toner 41 | B | B | 1.9% | B | A | 150° C. | B |
| Example 42 | Toner 42 | B | B | 1.9% | B | A | 150° C. | B |
| Example 43 | Toner 43 | B | B | 1.6% | B | B | 150° C. | B |
| Example 44 | Toner 44 | B | C | 1.7% | B | B | 150° C. | B |
| Comparative example 1 | Comparative toner 1 | C | D | 3.5% | D | C | 155° C. | C |
| Comparative example 2 | Comparative toner 2 | C | D | 3.1% | D | C | 155° C. | C |
| Comparative example 3 | Comparative toner 3 | C | D | 3.0% | D | C | 155° C. | C |
| Comparative example 4 | Comparative toner 4 | D | E | 2.1% | C | C | 160° C. | D |
| Comparative example 5 | Comparative toner 5 | C | D | 2.3% | C | C | 160° C. | D |
| Comparative example 6 | Comparative toner 6 | D | E | 2.2% | C | C | 155° C. | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-109990, filed Jun. 25, 2020, which is hereby incorporated by reference herein in its entirety.

What is claimed is:

1. A toner comprising:

a toner particle comprising a resin A, resin A being present at the surface of the toner particle and being represented by formula (1); and an external additive A, external additive A being a fine particle containing silicon

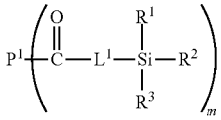

(1)

where $P^1$ denotes a polymer segment, $L^1$ denotes a single bond, an alkylene group having from 1 to 4 carbon atoms, —O—, —$OR^4$—, —NH—, —$NHR^5$— or a phenylene group, $R^4$ and $R^5$ are independently an alkylene group having from 1 to 4 carbon atoms or a phenylene group, and each carbon atom may have a hydroxyl group as a substituent group, at least one of $R^1$ to $R^3$ is a hydroxyl group or an alkoxy group, with the remainder independently denoting a hydrogen atom, a halogen atom, an alkyl group, an alkoxy group, an aryl group or a hydroxyl group, and m is a positive integer, with the proviso that when m is 2 or higher, a plurality of $L^1$ moieties, a plurality of $R^1$ moieties, a plurality of $R^2$ moieties and a plurality of $R^3$ moieties may be the same or different from each other, wherein the average value of the shape factor SF-1 of external additive A is 105 to 120, and the average value of the shape factor SF-2 of external additive A is 100 to 130.

2. The toner according to claim 1, wherein the number average primary particle diameter of external additive A is 30 to 300 nm.

3. The toner according to claim 1, wherein the content of the external additive A is 0.10 to 6.00 parts by mass relative to 100 parts by mass of the toner particle.

4. The toner according to claim 1, wherein external additive A comprises a silica fine particle.

5. The toner according to claim 1, wherein external additive A comprises an organosilicon polymer fine particle, an organosilicon polymer in the organosilicon polymer fine particle has a structure in which a silicon atom and an oxygen atom are bonded alternately, the organosilicon polymer has a T3 unit structure represented by $R^aSiO_{3/2}$ where $R^a$ denotes an alkyl group having 1 to 6 carbon atoms or a phenyl group, and in $^{29}$Si-NMR measurements of the organosilicon polymer fine particles the ratio of the area of a peak derived from silicon having the T3 unit structure relative to the total area of peaks derived from all silicon element contained in the organosilicon polymer in the organosilicon polymer fine particle is 0.70 to 1.00.

6. The toner according to claim 1, wherein the toner particle comprises an ester wax.

7. The toner according to claim 1, wherein $P^1$ is a polyester segment.

8. The toner according to claim 1, wherein $L^1$ is represented by formula (3):

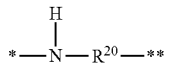

(3)

where * denotes a bonding segment to C═O, ** denotes a bonding segment to Si, $R^{20}$ denotes an alkylene group having 1 to 4 carbon atoms or a phenylene group, and each carbon atom may have a hydroxyl group as a substituent group.

9. The toner according to claim 1, wherein the content of silicon atoms in the resin A is 0.02 to 2.00 mass %.

10. The toner according to claim 1, wherein the content of the resin A in the toner particle is 0.1 to 10.0 mass %.

* * * * *